US009334647B2

(12) United States Patent
Elmer

(10) Patent No.: US 9,334,647 B2
(45) Date of Patent: May 10, 2016

(54) METHOD FOR HANDLING A HYDRO SOUND ABSORBER, AND DEVICE FOR REDUCING UNDERWATER NOISE

(71) Applicant: Karl-Heinz Elmer, Neustadt am Ruebenberge (DE)

(72) Inventor: Karl-Heinz Elmer, Neustadt am Ruebenberge (DE)

(73) Assignee: Karl-Heinz Elmer, Neustadt am Ruebenberge (DE)

( * ) Notice: Subject to any disclaimer, the term of this patent is extended or adjusted under 35 U.S.C. 154(b) by 0 days.

(21) Appl. No.: 14/387,551

(22) PCT Filed: Mar. 13, 2013

(86) PCT No.: PCT/DE2013/100096
§ 371 (c)(1),
(2) Date: Sep. 24, 2014

(87) PCT Pub. No.: WO2013/102459
PCT Pub. Date: Jul. 11, 2013

(65) Prior Publication Data

US 2015/0078833 A1 Mar. 19, 2015

(30) Foreign Application Priority Data

Mar. 26, 2012 (DE) ..... 10 2012 102 591
Feb. 8, 2013 (DE) ..... 10 2013 101 279

(51) Int. Cl.
*E02D 13/00* (2006.01)
*E04B 1/82* (2006.01)

(52) U.S. Cl.
CPC ..... *E04B 1/8209* (2013.01); *E02D 13/00* (2013.01); *E02D 13/005* (2013.01); *E02B 2201/00* (2013.01); *E04B 2001/8263* (2013.01)

(58) Field of Classification Search
CPC ..... E02D 13/00; E02D 13/005; E02B 3/062; E02B 17/0017
See application file for complete search history.

(56) References Cited

U.S. PATENT DOCUMENTS

| | | | | | |
|---|---|---|---|---|---|
| 3,548,605 | A * | 12/1970 | Armistead et al. | ..... | 405/60 |
| 3,599,434 | A * | 8/1971 | Missud | ..... | 405/60 |
| 3,653,215 | A * | 4/1972 | Crucet | ..... | 405/60 |
| 6,567,341 | B2 * | 5/2003 | Dreyer et al. | ..... | 367/1 |
| 2008/0006478 | A1 * | 1/2008 | Dreyer | ..... | 181/205 |
| 2009/0129871 | A1 * | 5/2009 | Mohr | ..... | 405/232 |
| 2011/0031062 | A1 * | 2/2011 | Elmer | ..... | 181/175 |
| 2013/0011203 | A1 * | 1/2013 | Reinhall et al. | ..... | 405/228 |
| 2014/0284139 | A1 | 9/2014 | Elmer | | |

FOREIGN PATENT DOCUMENTS

| | | | |
|---|---|---|---|
| DE | 102008017418 | A1 | 10/2009 |
| WO | WO 2009121336 | A2 | 10/2009 |
| WO | WO 2011046430 | A1 | 4/2011 |

* cited by examiner

*Primary Examiner* — Tara M. Pinnock
(74) *Attorney, Agent, or Firm* — Leydig, Voit & Mayer, Ltd.

(57) ABSTRACT

A method for handling a hydro sound absorber in the region of an offshore construction site. The method includes, prior to beginning noise-emitting work, positioning a hydro sound absorber in the region of the offshore construction site. The method includes positioning a transport housing receiving the hydro sound absorber close to at least one of a seabed or a surface of the water. The method also includes spreading out the hydro sound absorber from a first functional position out of the transport housing at least one of vertically to the extent of the offshore construction site or horizontally to the geometry of the seabed.

20 Claims, 22 Drawing Sheets

METHOD FOR HANDLING A HYDRO SOUND ABSORBER, AND DEVICE FOR REDUCING UNDERWATER NOISE

CROSS-REFERENCE TO RELATED APPLICATIONS

This application is a U.S. National Phase application under 35 U.S.C. §371 of International Application No. PCT/DE2013/100096, filed on Mar. 13, 2013, and claims benefit to German Patent Application No. DE 10 2012 102 591.6, filed on Mar. 26, 2012 and German Patent Application No. DE 10 2013 101 279.5, filed on Feb. 8, 2013. The International Application was published in German on Jul. 11, 2013, as WO 2013/102459 A2 under PCT Article 21 (2).

FIELD

The invention relates to a method for handling a hydro sound absorber in the region of an offshore construction site, in particular in the case of a pile to be introduced into the seabed, wherein, prior to the beginning of noise-emitting work, a hydro sound absorber is positioned in the region of the offshore construction site.

The invention furthermore relates to a device for reducing underwater noise and/or handling at least one hydro sound absorber in the region of an offshore construction site, in particular in the case of a pile to be introduced into the seabed, the device having at least one hydro sound absorber.

BACKGROUND

Piles are introduced into the seabed by means of drilling or ramming, in order to be used there as a foundation for marine construction work, in particular for offshore wind energy plants. The foundations generally consist of one or more piles. In the case of a foundation with only one pile, a single pile or monopile is referred to. In the case of a foundation comprising a plurality of piles, the latter is often introduced into the bed using so called templates. Foundations of this type are also called jacket foundations or tripod foundations.

In the case of a tripod foundation, the construction is assisted by a structure having three diagonal struts with additional horizontal reinforcements at the level of the seabed. At the ends of the struts facing the seabed, the latter are connected to piles introduced into the bed.

In the case of a jacket foundation, the construction is anchored to a framework structure made of hollow profiles, which is called a jacket. The framework structure is anchored using the piles introduced into the seabed. At least three piles are generally provided for a jacket foundation.

When using a tripod or a jacket, it has logistically proven to be advantageous if the piles are firstly introduced into the seabed, for example using a template, and at a later time, the jacket or tripod is connected to the piles, independently of the introduction of the piles in terms of time.

During the drilling and vibration ramming in the seabed, in particular during impact ramming of offshore piles, considerable sound emissions are emitted into the surrounding water from the piles introduced into the seabed, but also from the seabed. For the fish and sea mammals living in the water, these sound emissions can be harmful and life-threatening. The sound is produced at the friction face of the pile and seabed and is transmitted thereby into the water surrounding them.

SUMMARY

In an embodiment, the present invention provides a method for handling a hydro sound absorber in the region of an offshore construction site. The method includes, prior to beginning noise-emitting work, positioning a hydro sound absorber in the region of the offshore construction site. The method includes positioning a transport housing receiving the hydro sound absorber close to at least one of a seabed or a surface of the water. The method also includes spreading out the hydro sound absorber from a first functional position out of the transport housing at least one of vertically to the extent of the offshore construction site or horizontally to the geometry of the seabed.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
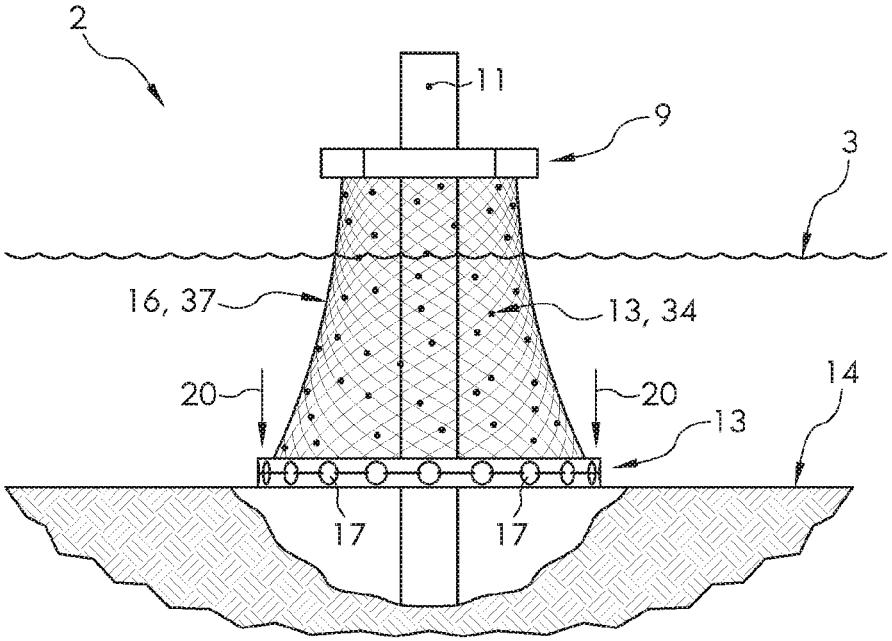
FIG. 1 shows, in a schematic view of a side view, the basic functioning principle of the invention with a hydro sound absorber, which sinks to the seabed when it is spread out.

The present invention provides a device for reducing water sound and bed vibrations in the case of pile foundations in the water. Water sound is also called hydro sound. To reduce the hydro sound, a hydro sound absorber, called an HSD for short, is known from the document DE 10 2008 017 418 A1. This hydro sound absorber consists of a plurality of absorbing elements spaced apart from one another to reduce the hydro sound, which are arranged uniformly distributed on a carrier structure, for example on a net. The carrier structure is arranged around a sound source at the site of use. A sound source is, for example, a pile, which is introduced into the seabed, which can take place by ramming or drilling.

In some embodiments, the invention involves providing a possibility, in which the transportation of a mechanism for reducing hydro sound over land and sea to the site of use and the arrangement and recovery at the site of use of a device of this type can take place rapidly, simply and economically, the device at the same time being suitable for protection against hydro sound over as large an area as possible.

According to an aspect of the invention, a method is provided, in which to arrange the hydro sound absorber in the region of the offshore construction site, a transport housing receiving the hydro sound absorber is positioned close to the seabed or close to the surface of the water and the hydro sound absorber is then spread out from a first functional position out of the transport housing, vertically or parallel to the extent of the pile and/or horizontally or parallel to the geometry of the seabed into a second functional position. As the hydro sound absorber can be spread out to its required extent at the site of use by means of the device according to the invention, mechanically, hydraulically and/or pneumatically, preferably in an automated manner, the arrangement of the hydro sound absorber is possible with a low outlay in terms of personnel and time. The same also applies to the removal of the hydro sound absorber from the site of use.

The device according to the invention is preferably equipped with a hydro sound absorber, the carrier structure of which is a net and the sound-reducing elements of which are foam elements suitable for reducing hydro sound and/or air-filled enveloping bodies.

Depending on the requirement of the hydro sound absorber, for example with respect to the depth of water at the installation site, it is provided that the hydro sound absorber is only partially or completely spread out from the first functional position out of the transport housing. Thus, a device with a hydro sound absorber for water depths of, for example, up to 30 meters can also be used in shallower bodies of water, for example with a water depth of only 10 meters. In this case, the hydro sound absorber is only partially spread out. The same also applies for the horizontal positioning parallel to the seabed. The hydro sound absorber is always spread out until it reaches a spread required for sound reduction. A spreading beyond this can be dispensed with according to the invention. This reduces the outlay when setting up the construction site and the number of types of devices to be kept available. In order to reduce the spreading of sound, the hydro sound absorber is arranged around the pile over the entire height of the water column, in other words from the seabed to the surface of the water.

As the intensity of the sound in the bed reduces with the distance from the sound source, it is favourable to provide a device, by means of which a hydro sound absorber can be arranged parallel to the seabed, the hydro sound absorber being spread out from the sound source up to a relevant distance for an adequate hydro sound reduction. The required relevant distance depends, inter alia, on the nature of the bed and the working energy when introducing the pile. As the vibrations in the seabed and the underwater noise influence one another, owing to the arrangement of the hydro sound absorber parallel to the seabed, on the one hand, the underwater noise can be minimised and, on the other hand, the vibration excitation of the seabed by the hydro sound and the spread of vibrations in the seabed can also be reduced.

It has also proven to be advantageous that on completion of the noise-emitting work, the hydro sound absorber is contracted from the second functional position and placed in the transport housing in the first functional position, the transport housing finally being removed from the offshore construction site. It is possible as a result to completely remove the device from the water, simply and with low outlay in terms of time. As the device is transferred back into its compact structure advantageous for transport on completion of the sound-emitting activities, the device is immediately available for reuse at a different construction site. At least the handling and storage on board a ship is possible without a large outlay.

According to the invention, a device is thus provided, which comprises a holding mechanism, on which a first, fixed end of the hydro sound absorber is held and in which a second free end of the hydro sound absorber remote from the first end of the hydro sound absorber is movable relative to the holding mechanism, in particular can be positioned remote from the holding mechanism. As a result it is possible to easily spread out the hydro sound absorber on site, even under the adverse conditions of an underwater construction site on the high seas, and to contract it again undamaged after it has been used. This mobility according to the invention is the basis for a device, which, on the one hand, in a first functional position of the hydro sound absorber, is simple to transport, to position at the construction site and to remove from the construction site and additionally allows an effective spreading of the hydro sound absorber over a large area.

According to a development of the invention it is provided that the device has at least one buoyancy body and/or a ballast body, the buoyancy body and/or the ballast body being connected to the second, free end of the hydro sound absorber. The first and the second end of the hydro sound absorber are configured to be movable relative to one another to unfold and contract the hydro sound absorber. The ballast body, also called the downthrust body, is configured in such a way that its specific weight is at least temporarily equal to or greater than the specific weight of the water surrounding the ballast body. To influence the ballast body, the latter can thus receive or discharge water or air and thus change its specific weight. Something similar also applies to the buoyancy body. The buoyancy body consists of one or more resilient chambers, which are empty and/or filled with air and/or fillable with water, or can be emptied of these substances. The buoyancy body has a specific weight, which is equal to or lower than the water surrounding the buoyancy body. The buoyancy body is substantially used to unfold the hydro sound absorber counter to the gravitational force, while the unfolding of the hydro sound absorber is achieved with the gravitational force by means of the ballast body. The ballast body and buoyancy body act in opposing directions.

It is advantageous that the device has a transport housing to store and transport at least one hydro sound absorber located in a contracted first functional position, the transport housing being connected to the first fixed end of the hydro sound absorber and/or to the second, free end of the hydro sound absorber. As a result, it is possible to firstly position the transport housing at the construction site and to only unfold the hydro sound absorber out of the transport housing shortly before the beginning of the sound production. Until the unfolding, the hydro sound absorber can await its use in the compact, contracted first functional position. After the end of the sound production, the hydro sound absorber is contracted again and stored in a space-saving manner in the transport housing. The compact transport housing is easy to handle.

For use in water, it has proven to be advantageous for the transport housing to be permeable to water, for example configured as a basket. The transport housing may consist of one or more containers. In one embodiment, the transport housing consists of two baskets open on one side, which are arranged inside one another with the open sides opposing one another. The hydro sound absorber is arranged here in the one basket open at the top and the second, slightly larger basket open at the bottom is arranged over the smaller basket in the first functional position of the hydro sound absorber. The hydro sound absorber is therefore completely and captively surrounded by the transport housing in the first functional position. In the second functional position of the hydro sound absorber, the two baskets of the transport housing are arranged remote from one another, the hydro sound absorber extending between the two baskets. According to a development of this embodiment, the two baskets are configured annularly and provided for concentric arrangement on the pile and/or around the introduction tool thereof. Before the hydro sound absorber is brought out, the smaller basket is firstly held by a lock in the larger basket. If the transport housing is positioned on the pile in the water, the lock can be opened.

The first end is also called the fixed end, as this end of the hydro sound absorber is connected to a holding mechanism, which is stationarily held while the hydro sound absorber is being brought out and hauled in. In contrast, the second end of the hydro sound absorber is movable as the free end. The second end is connected to a ballast body and/or a buoyancy body to bring out or haul in the hydro sound absorber.

The device or the hydro sound absorber, alternatively or additionally to the ballast body, comprises numerous ballast mechanisms. These are connected to the carrier structure and act to counteract the buoyancy of the carrier structure and/or the downward thrust of the absorbing elements. The ballast mechanisms are dimensioned to be adapted to the use depth, so their weight force reduces the buoyancy force of the hydro sound absorber or their weight force is significantly greater than the buoyancy force of the hydro sound absorber. The ballast mechanisms are therefore used as ballast bodies for the lowering, in particular of the second end of the hydro sound absorber. If the ballast mechanisms are at least partially, in particular uniformly, distributed over the hydro sound absorber, the carrier structure and/or the net, the tensile forces in the hydro sound absorber, the carrier structure and/or the net are significantly reduced compared to the solutions known from the prior art.

In one embodiment variant of the device, the immersion of the second end of the carrier structure connected to the ballast body or of the hydro sound absorber to the seabed is ensured by means of the ballast body. The opposing first end of the hydro sound absorber in this embodiment variant is held at or just above the surface of the water by a holding mechanism. The buoyancy of the hydro sound absorber and/or the holding mechanism, on the one hand, and the weight force of the ballast body and/or of the sound reduction elements, on the other hand, bring about a tightening and positioning of the preferably net-like carrier structure.

In one device, in which the first, fixed end of the hydro sound absorber is associated with the surface of the water, the holding mechanism is connected to an introduction tool or to the upper end of the pile. In the case of a holding mechanism connected to the introduction tool and/or to the pile, it is advantageous that the holding mechanism can be positioned together with the introduction tool or with the pile at the construction site, in particular can be lifted by means of the hoist of the pile and/or introduction tool from the ship. Thus, less technical equipment has to be kept available on the ship and the positioning of the device on the pile is facilitated. Before the hydro sound absorber is brought out, the latter is held in the transport housing, in particular by means of a lock. If the introduction tool is positioned on the pile in the water, the lock can be opened and/or the hydro sound absorber can be unfolded.

Alternatively, the holding mechanism is held by a positioning mechanism in the device. The positioning mechanism is independent of the hoist of the introduction tool. The hoist of the introduction tool and/or of the pile comprises, for example, a crane carried by a ship, with at least one winch and at least one cable connecting the winch to the pile and/or the introduction tool. The positioning mechanism, on the other hand, may have a separate crane on the same or a different ship. The positioning mechanism, according to a preferred embodiment, comprises at least one winch that is independent of the hoist of the introduction mechanism and a cable that is independent of the hoist of the introduction mechanism, which cable connects the independent winch to the holding mechanism. In another embodiment, the positioning mechanism is a holding means or a guide mechanism for the pile, which is, for example, arranged on the same ship as the hoist of the introduction mechanism, but can be used independently thereof.

The carrier structure is preferably a net, on which a plurality of sound reduction elements are preferably arranged uniformly distributed. The sound reduction elements of the hydro sound absorber are spaced apart from one another. They are also called absorbing bodies.

A development of the invention relates to a device, which has a cable, which connects the first, fixed end to the second, free end of the hydro sound absorber. The hydro sound absorber is freely movably arranged on the cable, in particular in an at least partially spread-out second functional position. The freedom of movement of the hydro sound absorber along the cable relates, in particular, to central regions between the first and second ends. This configuration is preferably used in a substantially vertically arranged hydro sound absorber, for example in the case of a hydro sound absorber arranged around a pile. The carrier structure is connected to the cable by means of rings or eyelets. In order to counteract the buoyancy of the sound reduction elements in the water, annular ballast mechanisms are preferably provided to connect the carrier structure and cable.

The hydro sound absorber is also subject to sea currents. So that these do not press the hydro sound absorber against the pile and the latter, resting thereon, is damaged or weakened with respect to its function, it has proven to be practical for the device to comprise spacers, which are arranged between the pile and the hydro sound absorber and are connected to the hydro sound absorber. The spacers are preferably configured as a ring or ring segment. It is advisable here for these spacers to simultaneously also be used as ballast mechanisms. For this purpose, the ballast mechanisms or spacers may be displaceably mounted for guidance on the cable.

In the embodiment mentioned above, the transport housing is arranged on an introduction tool and/or the pile. Another, alternative embodiment of the device provides that the transport housing is arranged on a template and/or a template is configured as a transport housing.

In this alternative embodiment of the device, the first, fixed end of the hydro sound absorber is associated with the seabed. The holding mechanism is connected here to the template, so the device, in particular the hydro sound absorber located in the first functional position, is positioned together with the template at the construction site. The hydro sound absorber can therefore already be fastened on land to the template during the production thereof or be integrated therein and is then towed with the template to the construction site. As a result, the outlay for assembly at sea is reduced and the positioning of the hydro sound absorber is simplified compared to the solutions known from the prior art.

In a device, in which the first end of the hydro sound absorber is fastened to the template, it has proven to be practical for the second end of the hydro sound absorber to be fastened to a buoyancy body. The buoyancy body is held on the transport housing in the first functional position of the hydro sound absorber. To unfold the hydro sound absorber, the buoyancy body is released from the transport housing and/or filled with a gas, preferably with air. The buoyancy body then rises, pulls the hydro sound absorber out of the transport housing in the process and unfolds the hydro sound absorber.

A development of this device has a collecting device to receive the buoyancy body. The collecting device is preferably arranged in the region of the surface of the water. It can float on the surface of the water and/or be held by a positioning mechanism. The positioning mechanism can be connected to a crane, the pile or the introduction tool. It is also possible for the collecting device to be fastened directly to the pile or the introduction tool.

The buoyancy body is preferably configured as at least one hollow body, in particular as a hose. The hollow body may be a steel tube, which can be filled with compressed air. Forming the buoyancy body from a flexible hose has proven to be particularly simple and space-saving, however. The hollow body is annular according to a favoured embodiment, in particular configured to surround the pile. The buoyancy body may also consist of a plurality of ring segments, which are arranged on one another surrounding the pile. The buoyancy body connected to the carrier structure of the hydro sound absorber, filled with air, climbs up the pile and in the process pulls the hydro sound absorber up. The hydro sound absorber thus envelops the pile from the bottom up to the buoyancy body. The lifting of the buoyancy body and therefore of the hydro sound absorber ends when the buoyancy body reaches the surface of the water or is received by the collecting device.

The collecting device may also be arranged under the surface of the water so the buoyancy body only runs through a partial section of the water column. This configuration may be used at great depths. It is possible here, for example, to provide two or more hydro sound absorbers arranged one above the other. Thus, for example, a first hydro sound absorber can extend from the seabed to the collecting device and a second hydro sound absorber can extend from the collecting device to the surface of the water. The vertical combination of a plurality of hydro sound absorbers is obviously also possible with the embodiment of the device, in which a ballast body is arranged on the second end of the hydro sound absorber.

The embodiment of the device with a buoyancy body, which pulls the hydro sound absorber out of the transport housing and unfolds it, is not imperatively limited to a template. It is also possible for a transport housing arranged on a holding mechanism, for example on a single pile, to be lowered to the seabed. The transport housing may, for this purpose, be let down by a positioning mechanism and held. A buoyancy body of the device is then activated and rises, guided on the cables of the positioning mechanism, and in the process unfolds the hydro sound absorber.

This mode of functioning is also possible while dispensing with the buoyancy body if the hydro sound absorber itself has an adequate buoyancy. A transport housing, preferably releasably fastened to a holding mechanism of the device, would then be let down by the positioning mechanism on the pile. The first end of the hydro sound absorber is connected to the holding mechanism. The second end of the hydro sound absorber is connected to a transport housing that is open at the bottom. If the transport housing is separated from the holding mechanism being used as a ballast body and closure of the transport housing, the transport housing rises up with the rising hydro sound absorber, the hydro sound absorber being pulled downward out of the transport housing.

The lowering of the ballast body or the lifting of the buoyancy body in the above-mentioned embodiments can also take place in a controlled manner. For this purpose, it is provided that the device comprises a pulling device for lowering and hauling up the second, free end of the hydro sound absorber, the pulling device having a drive assembly, in particular a cable winch, which is preferably arranged on the holding mechanism, and a pulling means, preferably a cable, which is connected, on the one hand, to the drive assembly and, on the other hand, to the second, free end of the hydro sound absorber. Thus it is, for example, possible by means of the pulling device comprising an underwater winch, to hold the buoyancy body, and therefore also the hydro sound absorber, in the transport housing against the buoyancy forces of the buoyancy body. The buoyancy body only rises or is hauled in again by the actuation of the pulling device. The same applies with the reversed directions of action for a device with a ballast body.

It has proven to be favourable that the cables and nets of the device consist of a textile material, for example of polyethylene fibres, in particular fibres made of an ultra-high molecular weight polyethylene such as, for example, Dyneema.

Apart from the vertical spreading of a hydro sound absorber, in other words, oriented parallel to the extent of the pile, it is furthermore favourable to spread a hydro sound absorber parallel to the seabed, in other words predominantly horizontally. For this purpose, the device has a spreading mechanism, which is fastened to the holding mechanism and/or to the template. The horizontal arrangement of the hydro sound absorber substantially contributes to the reduction in the hydro sound. The sound emitted from the seabed into the water is partially reflected by the water masses and introduced back into the bed. The sound introduced into the bed again is passed on by the bed as a bed vibration and also emitted back as sound to the water. Thus the sound does not spread exclusively by means of the water or the seabed, but also by means of the interaction between the water and seabed. A hydro sound absorber arranged horizontally or parallel to the seabed acts like a parallel absorbing layer. Apart from the sound emitted by the bed into the water, the intensity of the reflection of the sound and therefore of the reintroduction of the sound following this into the bed is also reduced. This minimises the water sound as a whole.

A spreading of the hydro sound absorber from 10 to 15 meters around the pile has proven to be sufficient in most applications.

A sensible supplement to the device is that the device has at least one decoupling mechanism, which is arranged on the lower side of the holding mechanism and/or the transport housing and/or the template, in particular between the seabed and the lower side. As a result, it is possible to minimise the transmission of the bed vibrations to the parts of the device touching the seabed, so the emission of sound into the water is reduced by these parts. The decoupling of the parts of the device touching the seabed, in particular the bulky parts like the holding mechanism, the ballast body or the template, reduces the interaction of the sound transmission between the seabed and the water, and therefore the hydro sound. The resilient decoupling mechanism preferably consists at least of a polymer and/or a coil spring and/or a foam body and/or a gas cushion.

The invention allows various embodiments. To further illustrate their basic principle, some of these are shown in the drawings and will be described below.

During underwater work, in particular when introducing a pile 11 into the seabed 14, the sound being produced is emitted from the pile 11 into the water 12 surrounding it. Owing to the vibrations in the seabed 14, sound is also emitted into the water 12. To reduce the hydro sound, in other words the sound in the water 12, a device 2 is provided, of which some embodiments will be described in more detail below. The method according to the invention will also be described in the embodiments of the device 2 shown in the figures.

The method is used for handling a hydro sound absorber 1 in the region of an offshore construction site, in particular in the case of a pile 11 to be introduced into the seabed. Before the beginning of the noise-emitting work at the offshore construction site, the hydro sound absorber 1 has to be positioned in the region of the offshore construction site. To arrange the hydro sound absorber 1, a transport housing 5 is positioned close to the seabed 14 or close to the surface 3 of the water. The hydro sound absorber 1 is mounted and transported in the transport housing 5 in a first functional position. If the transport housing 5 is positioned as provided, the hydro sound absorber 1 is spread out from the first functional position out of the transport housing 5 vertically, parallel to the extent of the pile and/or horizontally, parallel to the geometry of the seabed 14 into a second functional position. On conclusion of the noise-emitting work at the offshore construction site, the hydro sound absorber 1 is contracted from the second functional position and placed in the transport housing 5 in the first functional position. Finally, the transport housing 5 is removed from the offshore construction site.

Figure 2:
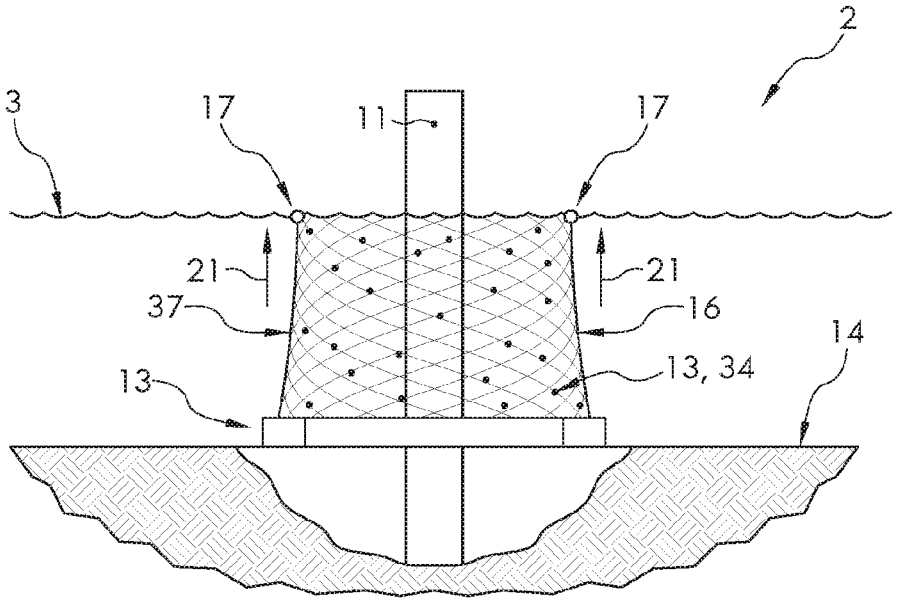
FIG. 2 shows, in a schematic view of a side view, the basic functioning principle of the invention with a hydro sound absorber, which rises to the surface of the water when it is spread out.
Figure 3:
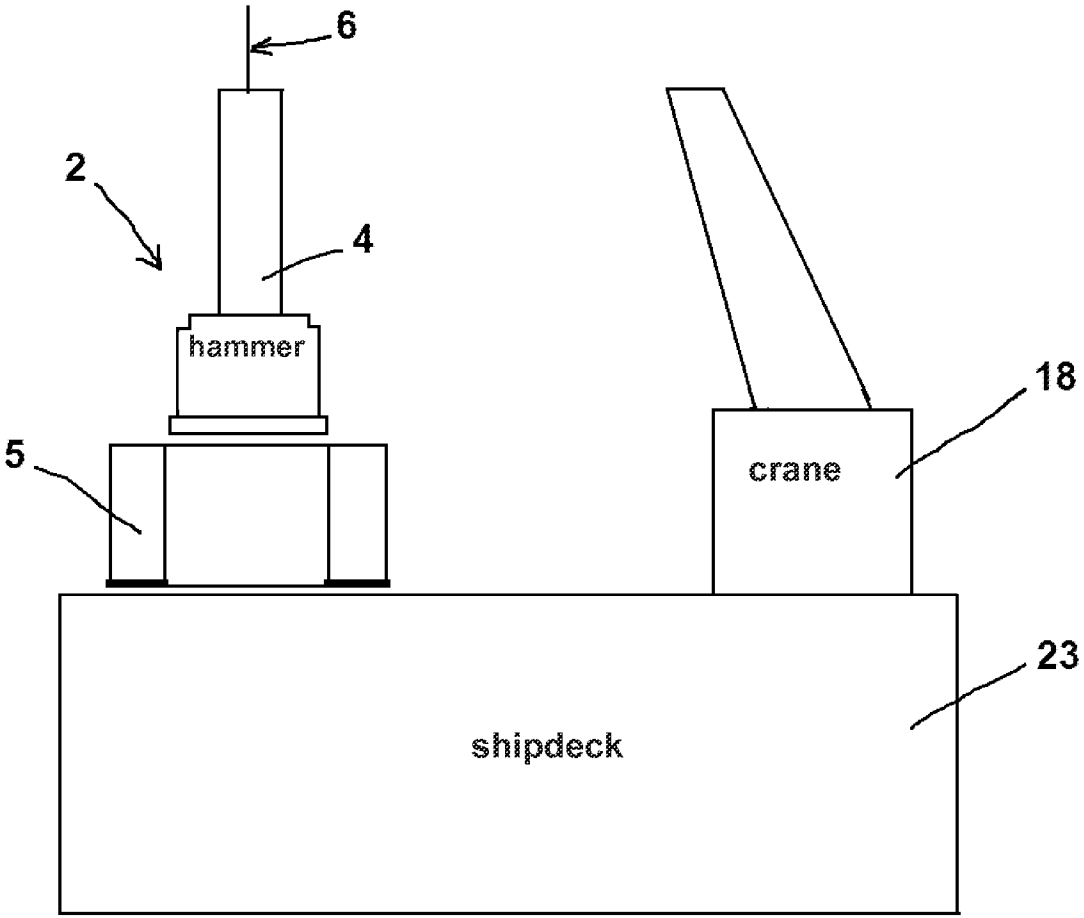
FIG. 3 shows, in a schematic view, a first configuration of the invention with the device on a ship.

The basic functioning principle of the invention is shown in FIGS. 1 and 2. The device 2 comprises a hydro sound absorber 1, the opposing ends of which associated with the surface 3 of the water or the seabed 14 are connected to at least one buoyancy body 17 and/or at least one ballast body 13. In this case, the end of the hydro sound absorber 1 associated with the surface 3 of the water is connected to a floating mechanism 9 or a buoyancy body 17, while the opposing end of the hydro sound absorber 1 facing the seabed 14 is connected to a ballast body 13. The ends of the hydro sound absorber 1 can be moved relative to one another by means of the selectable filling of the buoyancy bodies 17 and/or ballast bodies 13 with gas and/or water or by means of the positioning mechanism 7 shown in FIG. 3 and/or the pulling device 32 shown in FIG. 11. If the spacing between the ends increases, the hydro sound absorber 1 spreads out. If the spacing reduces, the hydro sound absorber 1 is contracted.

FIG. 1 shows an example, in which a ballast body 13 is lowered 20 from a floating mechanism 9 in the direction of the seabed 14. In this case, the hydro sound absorber 1 is spread out. For example, the ballast mechanism 13 can be lowered 20 by means of a pulling device 32, and can rise 21 by means of the latter and/or controlled buoyancy bodies 17, which are only filled with air when necessary.

FIG. 2 shows a device 2, in which the hydro sound absorber 1 has buoyancy bodies 17 at one end, which rise 21 from the seabed 14 to spread the hydro sound absorber 1. The other end of the hydro sound absorber 1 is fastened to a ballast body 13.

For lowering 20 and lifting 21, the ballast bodies 13 or the buoyancy bodies 17 consist of chambers, into which, as required, water and/or gas, preferably air, can be filled or removed. The lowering 20 of the hydro sound absorber 1 allows intermittent shipping traffic over the hydro sound absorber 1, for example in the case of relatively long work interruptions. Chambers, which are used as ballast bodies 13 and/or buoyancy bodies 17, are also fastened between the two ends, in particular uniformly distributed on the carrier structure 16, in one embodiment variant.

In a first configuration of the invention, which is shown in FIGS. 3 to 7, a device 2 is provided, in which the transport housing 5 with the folded hydro sound absorber 1 is held by a crane 18. The crane 18 is arranged as part of a positioning mechanism 7, also called a lifting device, of the hydro sound absorber 1 on a ship 23. The crane 18 in the first configuration shown, is simultaneously also part of a hoist 6 of an introduction tool 4. The introduction tool 4, for example a ramming tool, is used to introduce the pile 11 into the seabed 14.

The positioning mechanism 7 receives the transport housing 5. The transport housing 5 is in this case arranged around the introduction tool 4, which is held by a cable of the hoist 6. The positioning mechanism 7 and the hoist 6 are independent of one another. They comprise separate cables and winches that are independent of one another. In order to adhere to a spacing from the introduction tool 4, the positioning mechanism 7 comprises a crossbeam 8. As an alternative to the crossbeam 8, the positioning mechanism 7 may also comprise a plurality of cables. The transport housing 5 is attached by means of at least three, rather four cables, to the crossbeam 8.

The transport housing 5, before the introduction of the arrow 11, is positioned close to, in particular above, the head 10 of the pile 11, but at least at or above the surface 3 of the water. The head 10, during the introduction of the pile 11 into the seabed 14, may be above or else below the surface 3 of the water. The transport housing 5 is held in its position during the ramming work or lowered to the surface 3 of the water. To float on the surface 3 of the water, a floating mechanism 9 shown in FIG. 8 may be arranged on the transport housing 5.

Before the beginning of the introduction of the pile 11 into the seabed 14 and/or of the holding mechanism 15, a ballast body 13 is let down by means of a pulling device 32 onto the seabed 14. Using the ballast body 13, the carrier structure 16 of the hydro sound absorber 1 is spread out from the transport housing 5 along the pile 11 to the seabed 14. The carrier structure 16 of the hydro sound absorber 1 is movably mounted at regular intervals on the cables 37 that are under tension.

After the introduction of the pile 11, the hydro sound absorber 1 is recovered. For recovery, the ballast body 13 is pulled up again to the transport housing 5, the hydro sound absorber 1 being arranged in the transport housing 5.

Figure 4:
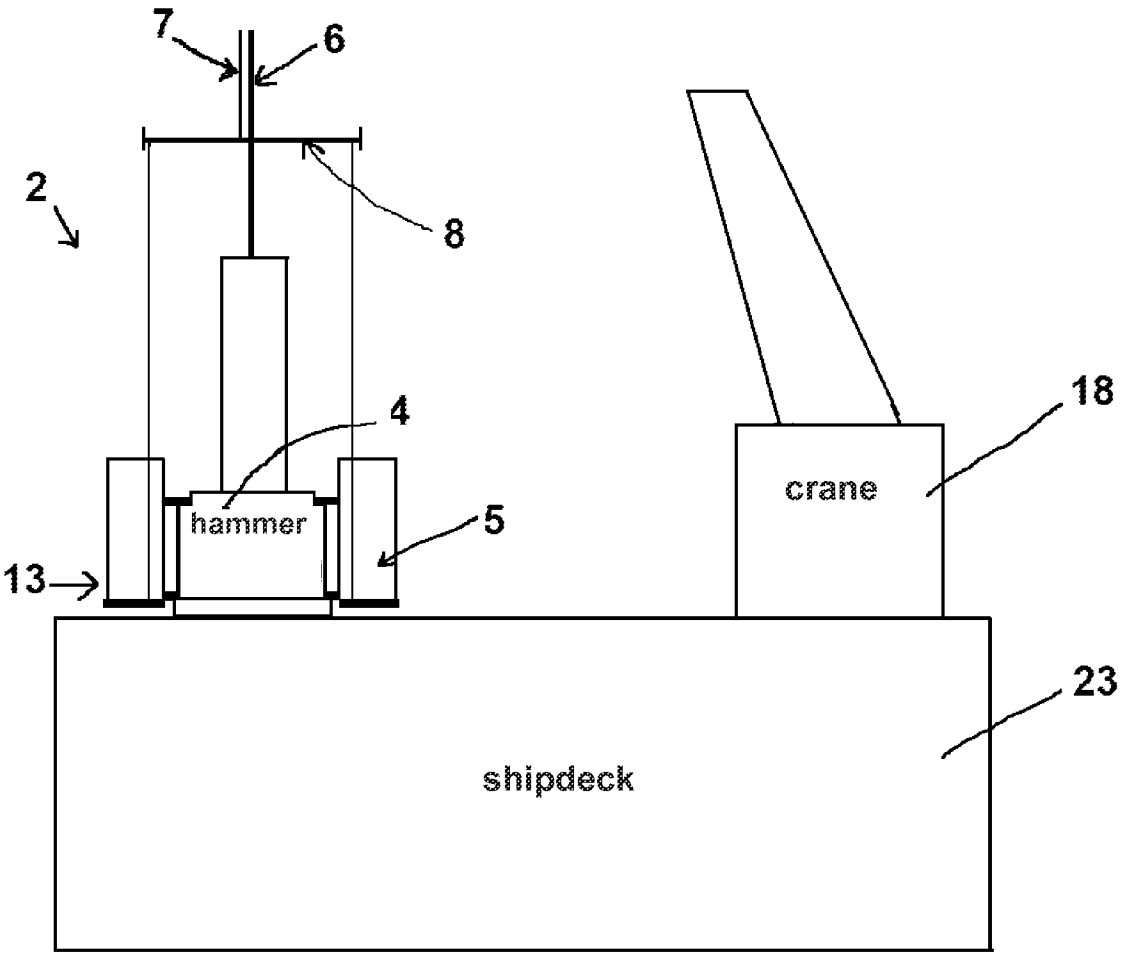
FIG. 4 shows, in a schematic view, a first configuration of the invention with the device fastened to an introduction tool.
Figure 5:
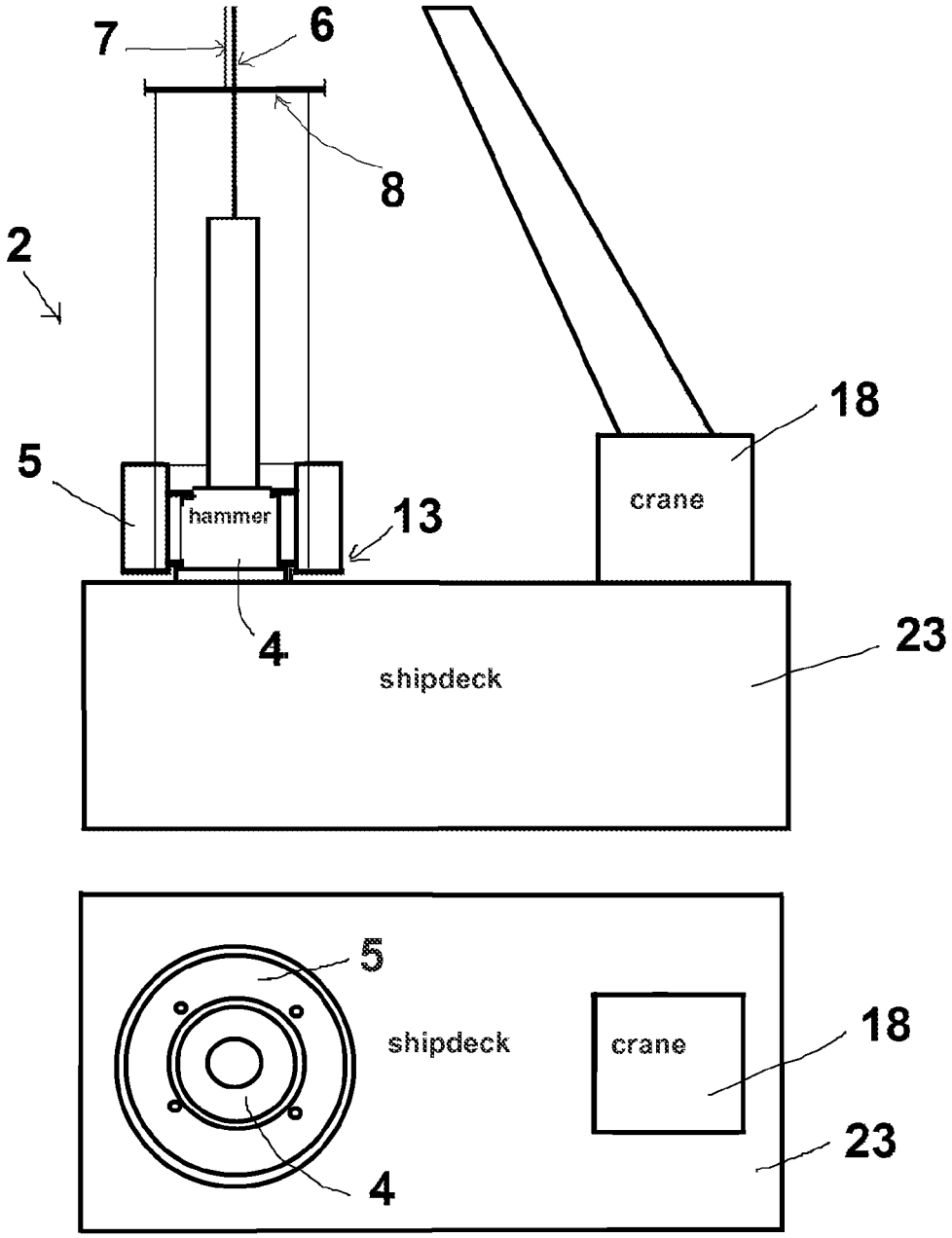
FIG. 5 shows, in a schematic view, a first configuration of the invention with the device fastened to an introduction tool.
Figure 6:
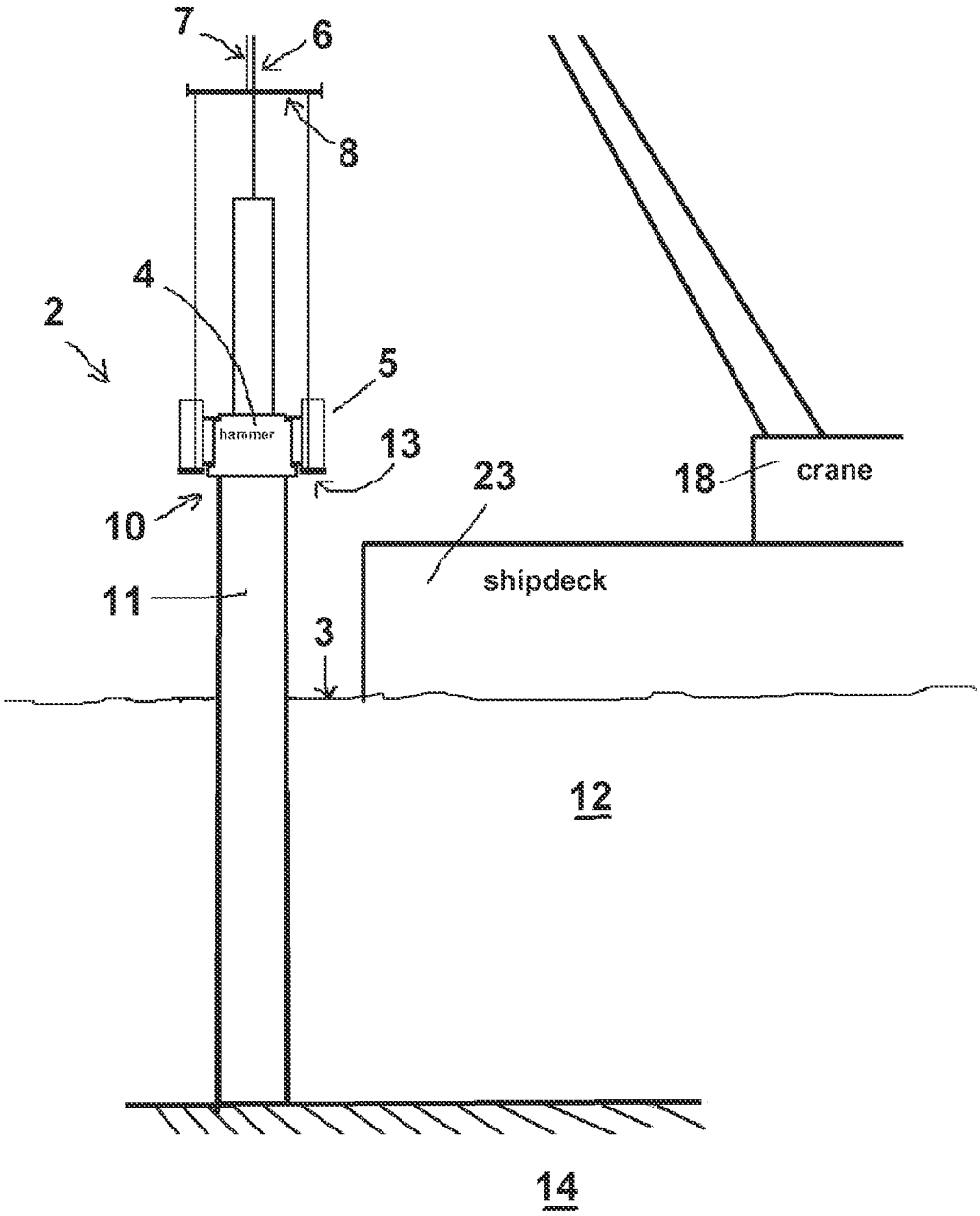
FIG. 6 shows, in a schematic view, a first configuration of the invention with the device prior to the beginning of the introduction of a pile into the seabed, the hydro sound absorber being in a first functional position.
Figure 7:
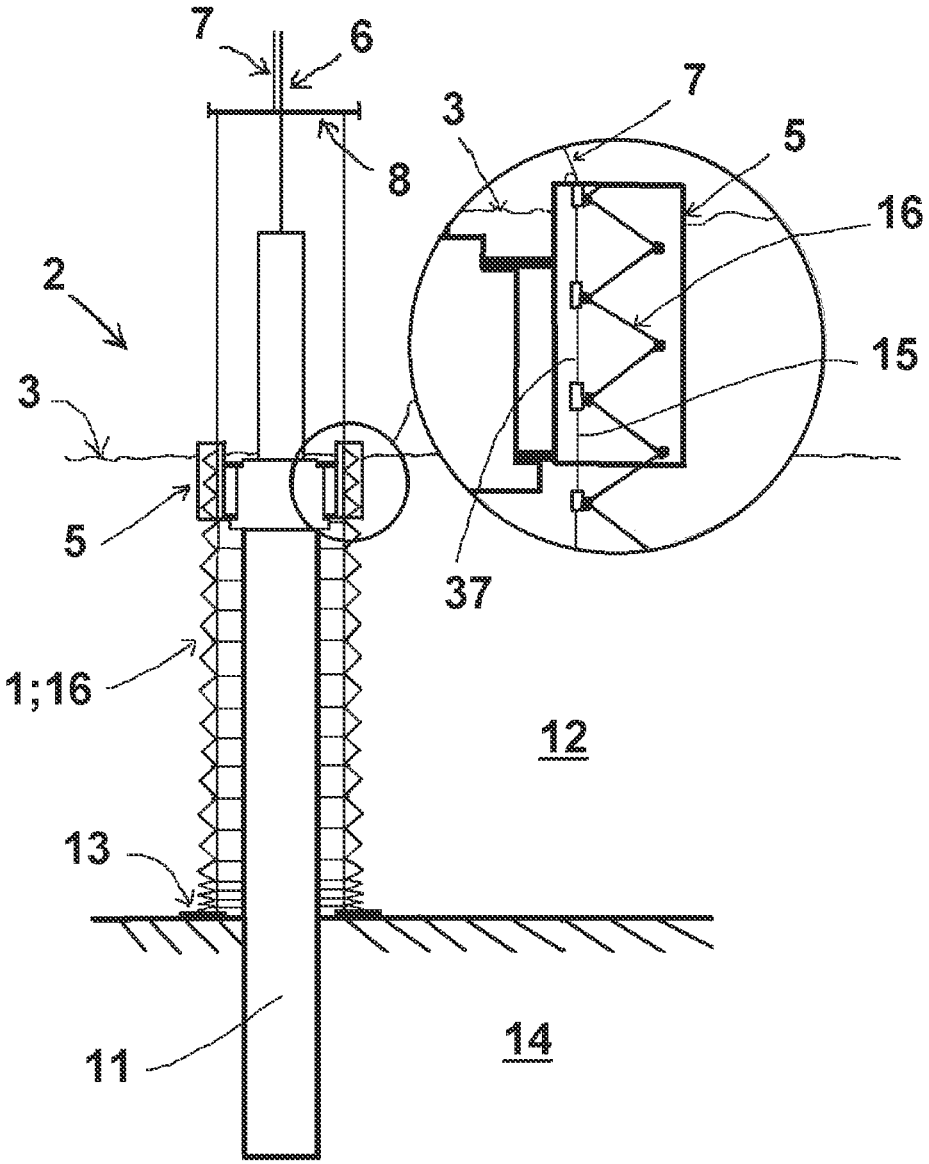
FIG. 7 shows, in a schematic view, a first configuration of the invention with the device on introduction of the pile into the seabed, the hydro sound absorber being in a second functional position.
Figure 8:
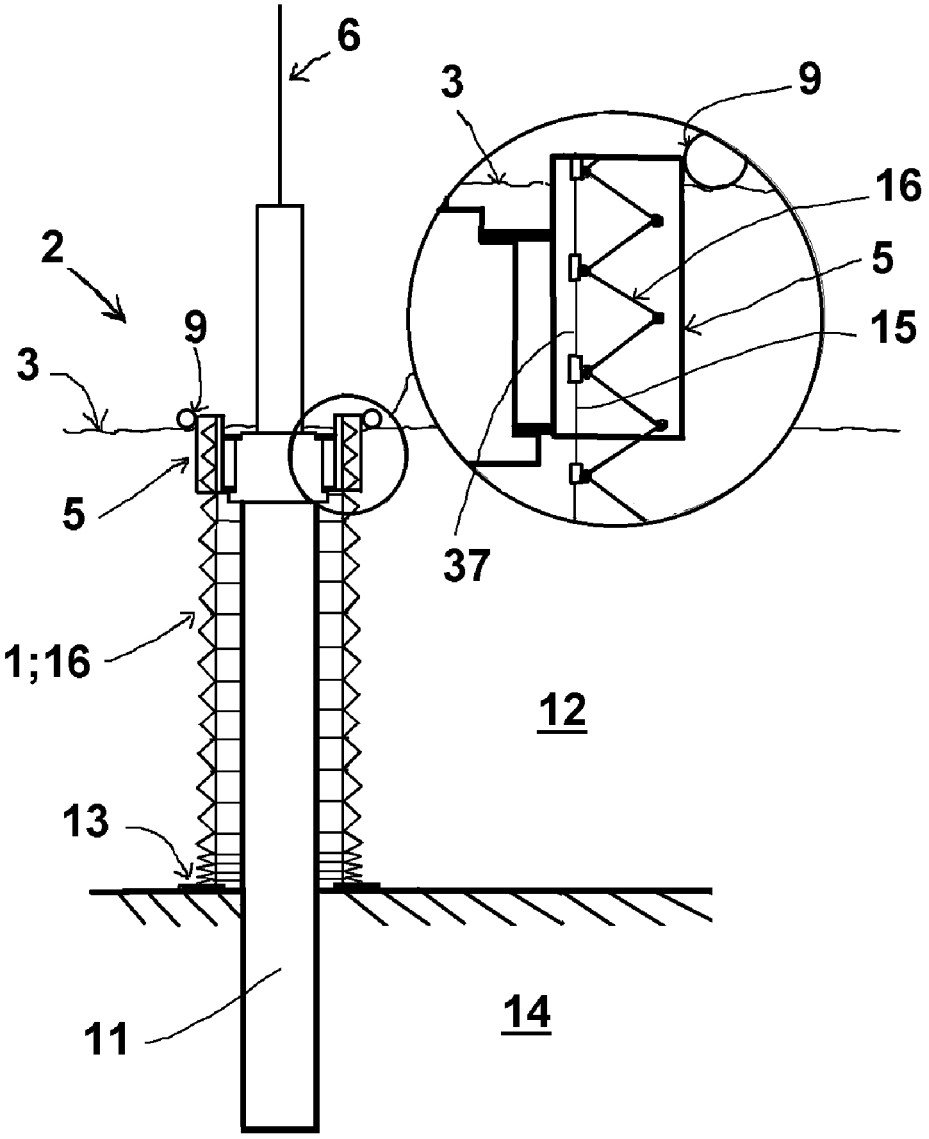
FIG. 8 shows, in a schematic view, a second configuration of the invention with the device on introduction of a pile into the seabed, the hydro sound absorber being in a first functional position.

FIG. 8 shows a second configuration of the invention, in which the device 2 is equipped with a floating mechanism 9. The floating mechanism 9 is connected to the transport housing 5. To position the transport housing 5, a positioning mechanism 7 as shown in FIGS. 4 and 5 was used. As soon as the transport housing 5 floats on the surface 3 of the water, the positioning mechanism 7 is no longer necessary and can be released from the transport housing 5. As the transport housing 5 surrounds the pile 11, said position mechanism cannot drift away. The lowering of the ballast body 13 and hydro sound absorber 1 before the beginning of the introduction and the recovery of the hydro sound absorber 1 takes place as already described above by means of a pulling device 32 arranged on the transport housing 5.

Figure 9:
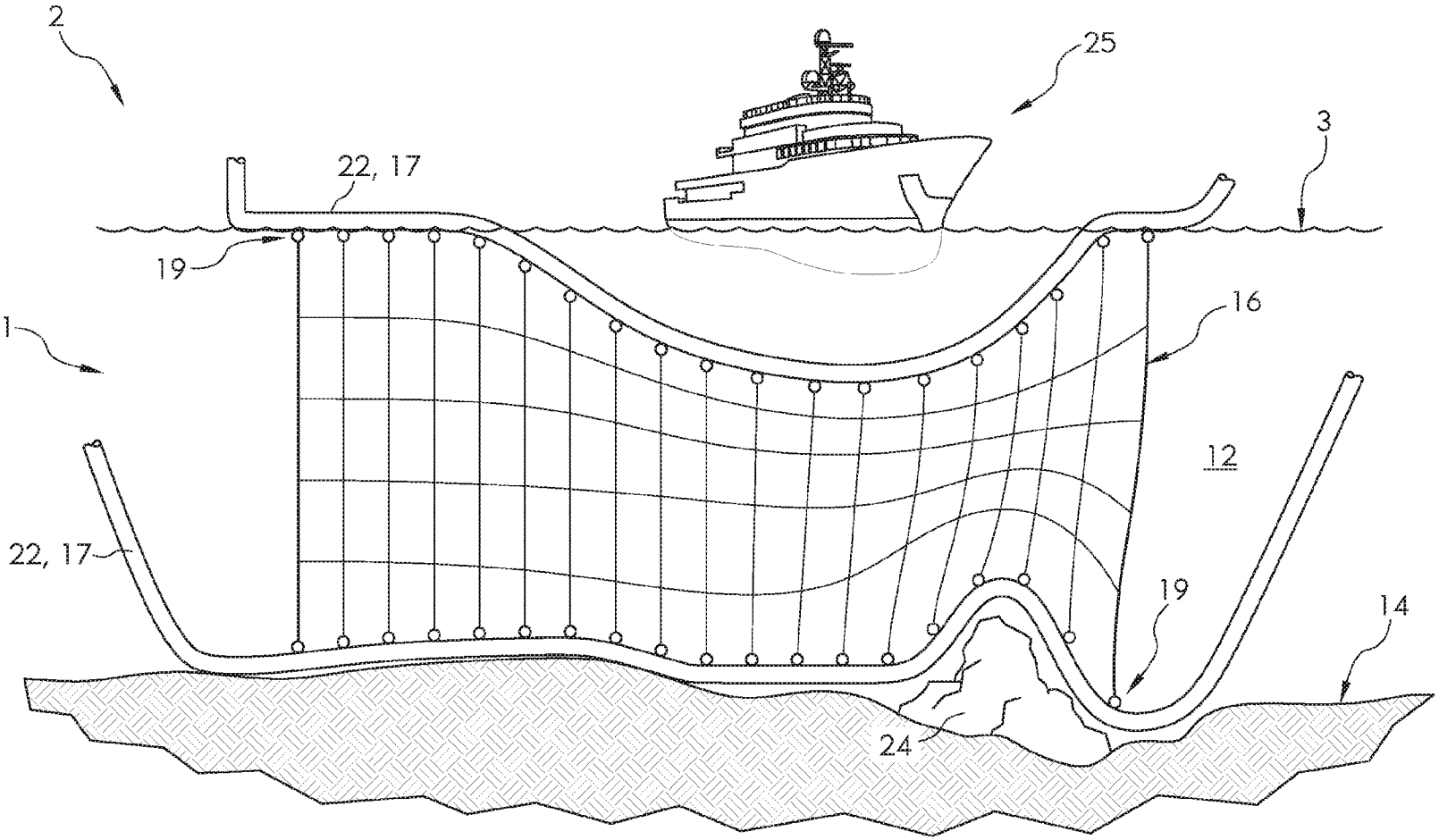
FIG. 9 shows, in a schematic view, a third configuration of the invention with the device.
Figure 10:
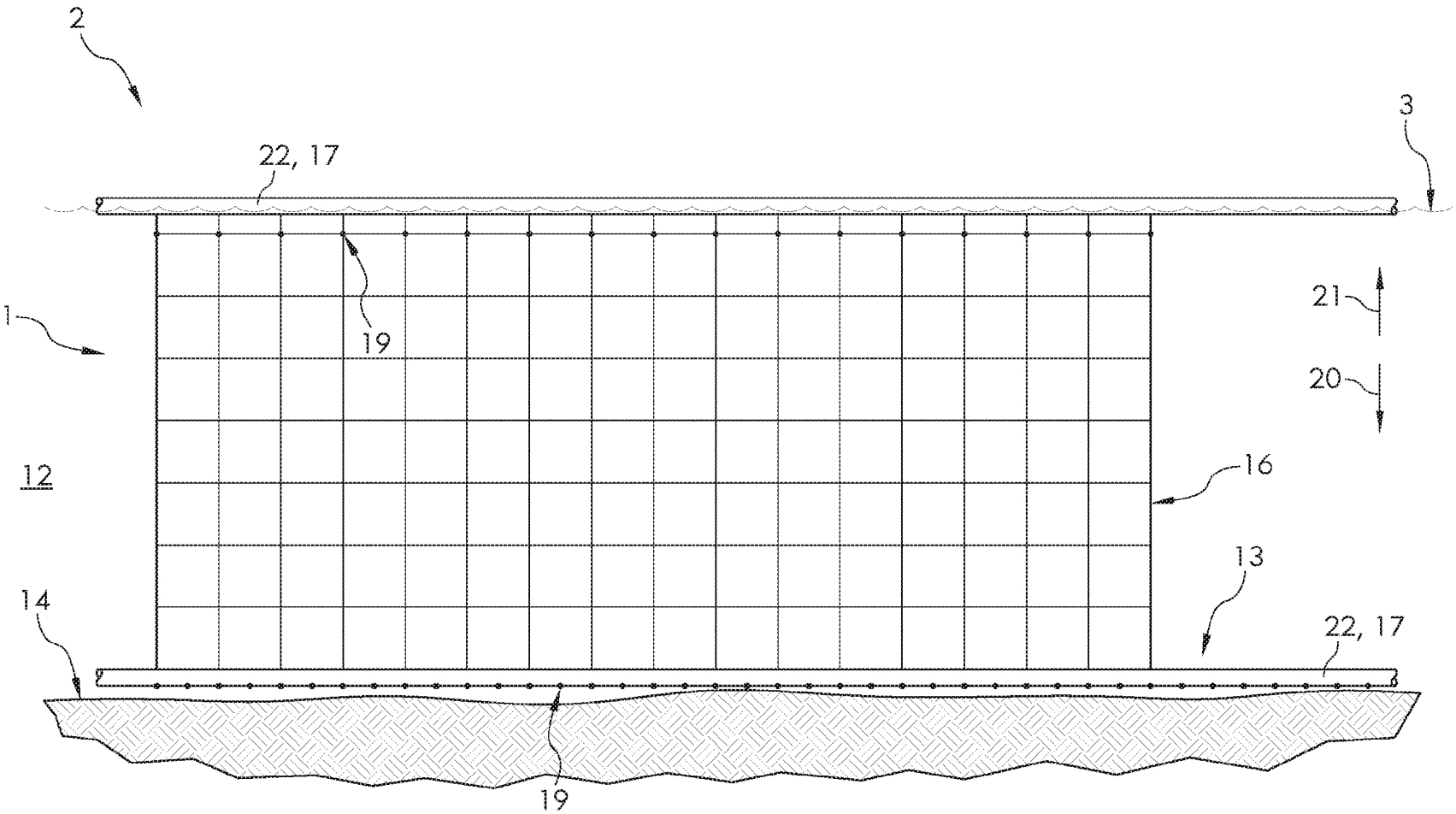
FIG. 10 shows, in a schematic view, a third configuration of the invention with the device.

FIGS. 9 and 10 show a third configuration of the invention. In this device 2, the carrier structure 16 of the hydro sound absorber 1 is connected to a buoyancy body 17 and a ballast mechanism 13. The buoyancy body 17 and/or the ballast body 13 in each case consist of a hose 22, on which the carrier structure 16 of the hydro sound absorber 1 and weights 19 are fastened as additional ballast bodies 13. For rising 21, the hose 22 is filled with air. For lowering 21, the air is let out of the hose 22 and/or the hose 22 is filled with water.

The use of a hose 22 has the advantage that the hydro sound absorber 1 can be positioned with the contour flush with the seabed 14. In this case, the ballast mechanism 13 is placed on obstacles 24, such as, for example, rocks. The portion-wise, as shown in FIG. 9, or complete lowering 20 of the buoyancy body 17 makes it possible to at least temporarily allow crossing shipping traffic 25 when there is a spread-out hydro sound absorber 1.

The weights 19 and the water-filled hose 22 of the ballast mechanism 13 rest on the seabed 14. In the case of a sensitive seabed 14, for example in the case of mussel beds, the hose 22 can also only be filled with so much air and/or water that the ballast mechanism 13 hovers a few decimeters above the seabed 14 and therefore does not rub against it in the case of current movements. The weights 19 may, for example, be a chain.

Figure 11:
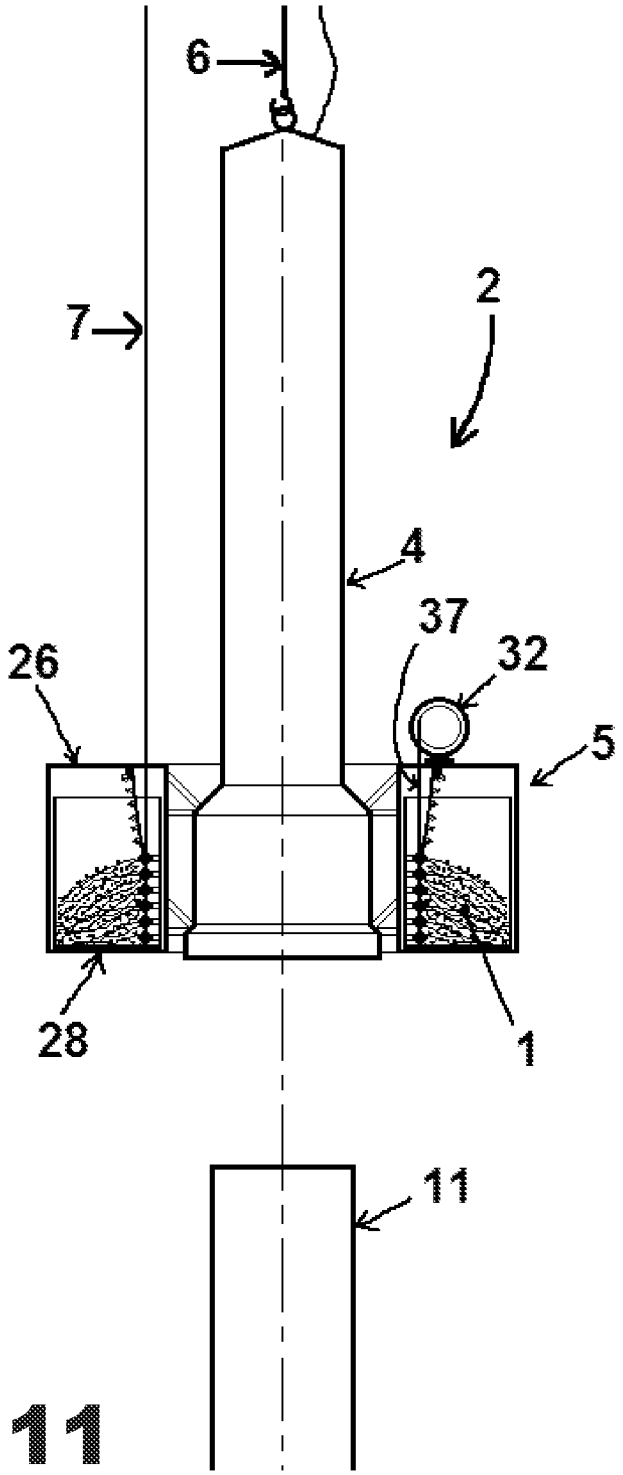
FIG. 11 shows, in a schematic view, a fourth configuration of the invention with the device before placing an introduction tool on a pile.
Figure 12:
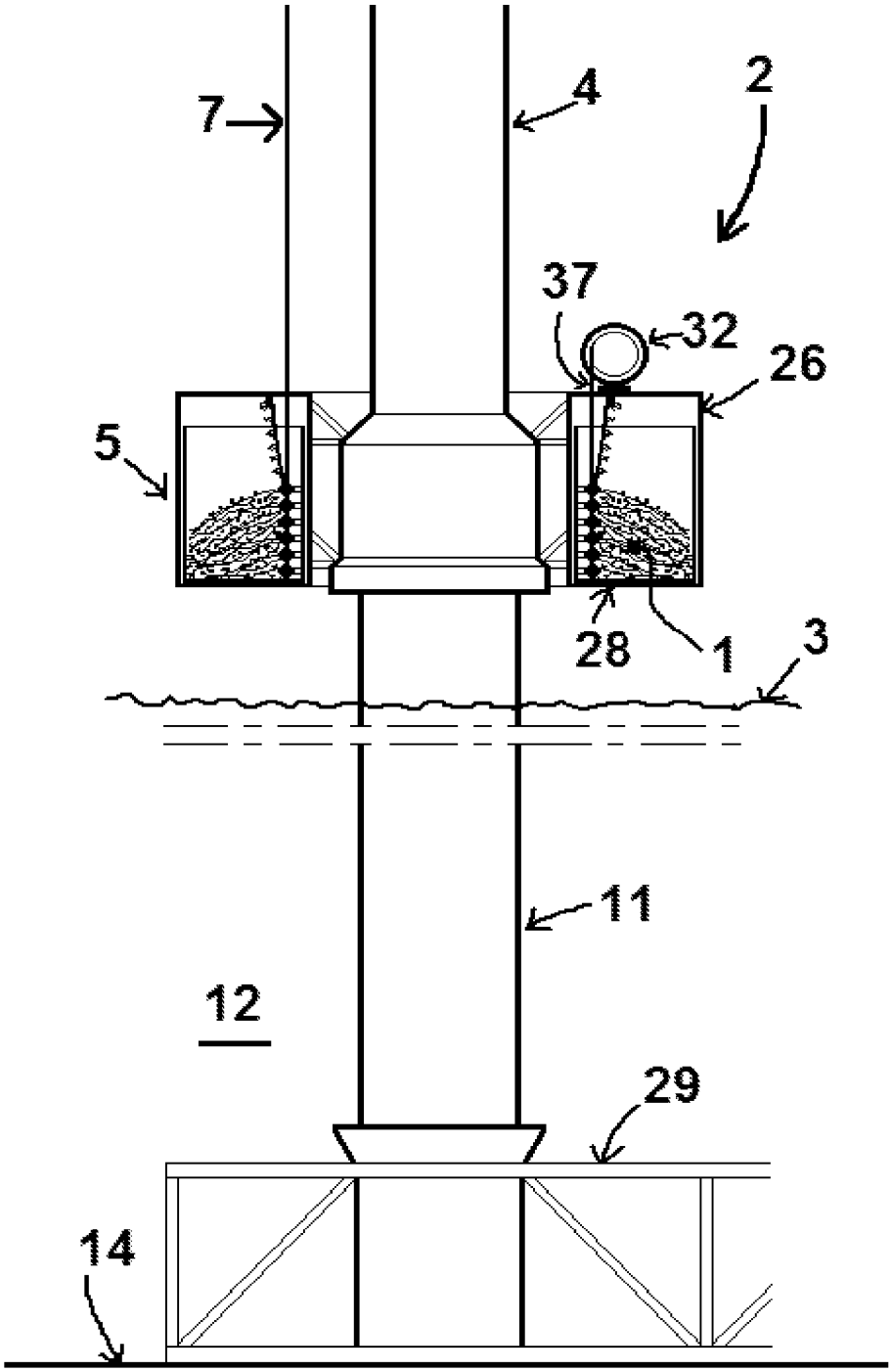
FIG. 12 shows, in a schematic view, a fourth configuration of the invention with the device before the introduction of a pile into the seabed.
Figure 13:
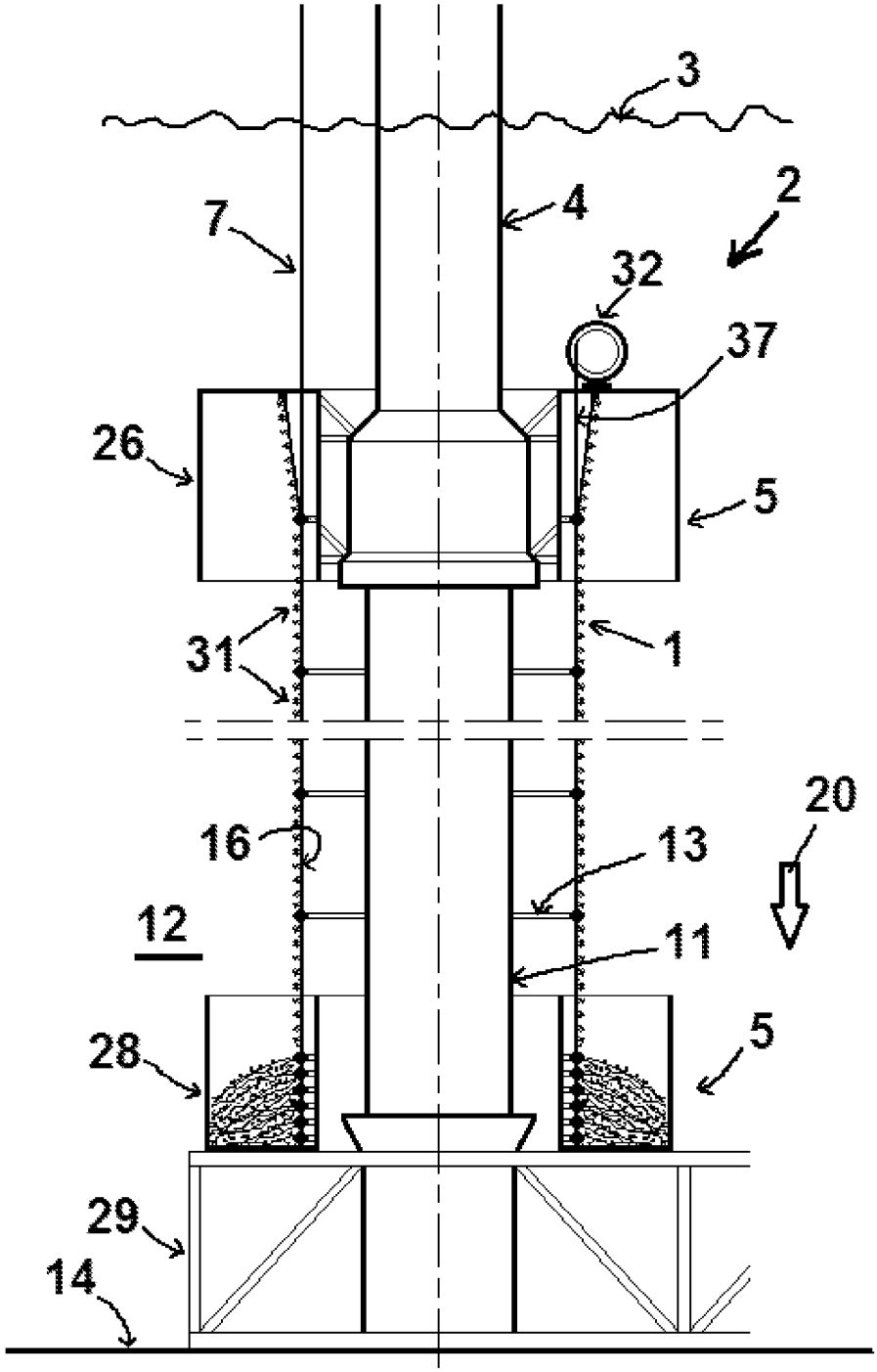
FIG. 13 shows, in a schematic view, a fourth configuration of the invention with the device on introduction of a pile into the seabed.

FIGS. 11 to 13 show a fourth configuration of the invention. The device 2 according to the invention is fastened to the introduction tool 4 and comprises a transport housing 5, in which the hydro sound absorber 1 is arranged, in particular for transportation to and from the site of use. The introduction tool 4 is suspended on a hoist 6. The transport housing 5 is arranged around the introduction tool 4 and consists of two annular baskets 26, 28 pushed into one another. The smaller basket 28 arranged on the inside contains the hydro sound absorber 1. The larger basket 26 arranged on the outside is open at the bottom and fastened by means of a holding mechanism 15 on the introduction tool 4, a hydraulic ramming hammer. The hydro sound absorber 1 comprises at least one net as a carrier structure 16 and, arranged thereon, a plurality of sound reduction elements 31 to reduce the hydro sound.

The upper end of the carrier structure 16 is fastened to the larger basket 26. The smaller basket 28 is connected to the positioning mechanism 7 or to a pulling device 32. Alternatively, the larger basket 26, similarly to the configuration of FIGS. 3 to 7, is held by means of the positioning mechanism 7, the smaller basket 28 then being connected to a pulling device 32 or a second hoist for lowering 20. The larger basket 26 can be fastened by means of the holding mechanism 15, but also with a pile guide arranged close to the surface 3 of the water or on the installation ship. The pulling device 32 is preferably an electric or hydraulic underwater winch.

Before the hydro sound absorber 1 is brought out, the first basket 28 is firstly held by a lock in the second basket 26. If the introduction tool 4 is positioned on the pile 11 in the water 12, the lock can be opened.

FIG. 12 shows how the pile 11 is held and guided by a template 29 positioned on the seabed 14. The introduction tool 4 can be placed on the pile 11 both above the surface 3 of the water, as shown in FIG. 12, and below the surface 3 of the water, as shown in FIG. 13.

To bring out the hydro sound absorber 1, the first basket 28 is let down to the seabed 14 or to the template 29 by actuating the positioning mechanism 7 or the pulling device 32 In this case, the pile 11 is completely enveloped by the hydro sound absorber 1, as indicated in FIG. 13.

In order to counteract the buoyancy of the sound reduction elements 31 in the water 12, annular ballast mechanisms 13 are fastened to the carrier structure 16. The ballast mechanisms 13 pull the hydro sound absorber 1 with the first basket 28 downward and at the same time act as spacers from the pile 11. The ballast mechanisms 13 are mounted for guidance on the cables 37 of the positioning mechanism 7 or the pulling device 32.

Figure 14:
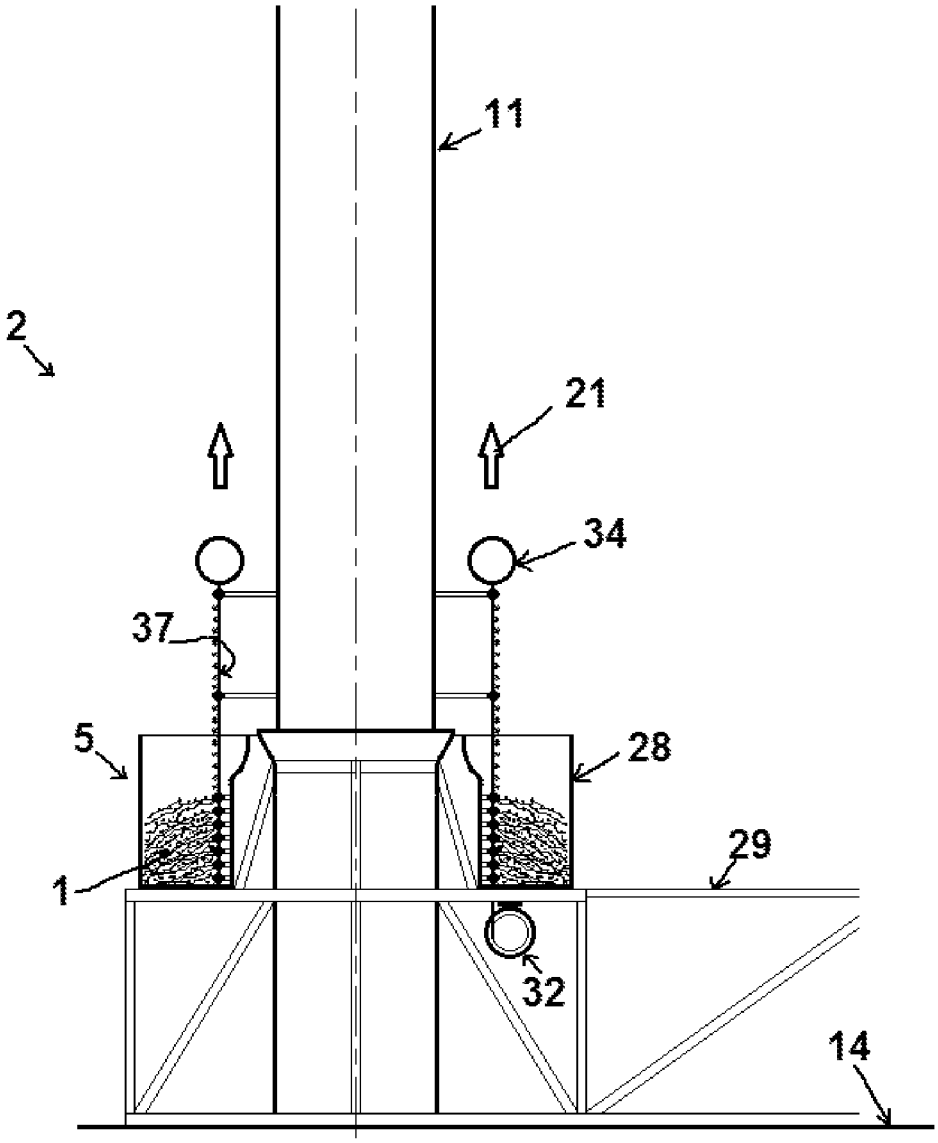
FIG. 14 shows, in a schematic view, a fifth configuration of the invention with the device when the hydro sound absorber is being spread out.
Figure 15:
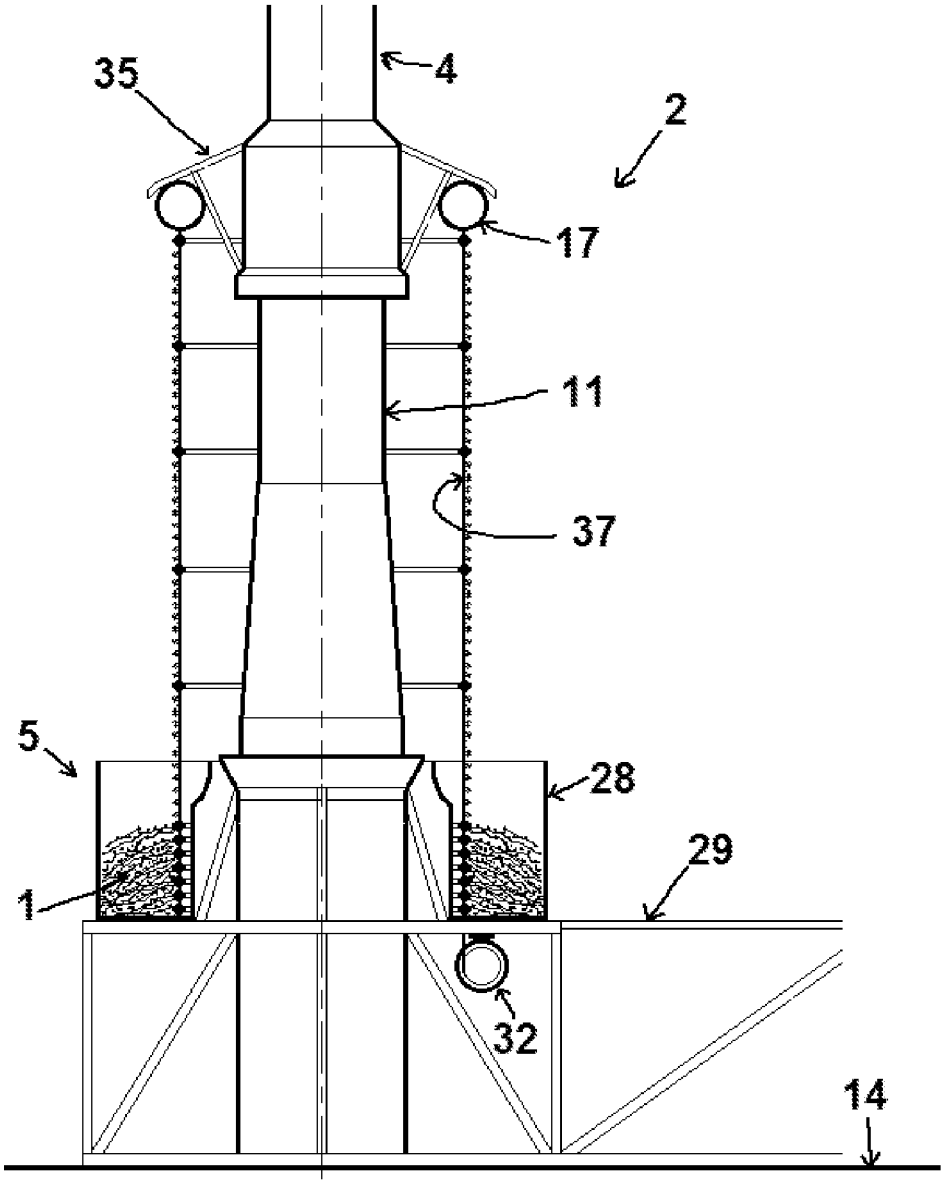
FIG. 15 shows, in a schematic view, a fifth configuration of the invention with the hydro sound absorber spread out.

FIGS. 14 and 15 show a fifth configuration of the invention. The device 2 according to the invention has a transport housing 5, which comprises an annular basket 28 open at the top, in which the hydro sound absorber 1 is received. The basket 28 can be let down to the seabed 14 or is fastened to a template 29 positioned on the seabed 14. The weight forces of the ballast mechanisms 13 described above, the spacers, the carrier structure 16 and/or a lock, or a pulling device 32 hold the hydro sound absorber 1 in the basket 28.

The device 2 comprises an annular buoyancy body 17, which is fastened to the carrier structure 16 of the hydro sound absorber 1. The buoyancy body 17 is an annular continuous hose or is composed of a plurality of individual segments. Filled with air, the buoyancy body 17 pushes to the surface 3 of the water. The buoyancy body 17 can either only be filled with air for rising 21, or can permanently be filled with air. The buoyancy body 17 is preferably held by a locking mechanism on the transport housing 5. The rising 21 buoyancy body 17 pulls the hydro sound absorber 1 upward along the pile 11. The hydro sound absorber 1 envelops the pile 11 from the bottom up to the buoyancy body 17. The rising 21 of the buoyancy body 17, and therefore of the hydro sound absorber 1, ends when the buoyancy body 17 reaches the surface 3 of the water or is received by a collecting device 35 of the device 2. The collecting device 35 is preferably fastened to the introduction tool 4.

By discharging the air filling in the buoyancy body 17, the hydro sound absorber 1 can be lowered again step-wise. Additional, separate cables are unnecessary in this embodiment variant. A variant with at least one additional pulling device 32 for cable tensioning is shown in the respective right-hand picture half of FIGS. 14 and 15. By means of the pulling device 32 configured as an underwater winch, it is possible to hold the hydro sound absorber 1 in the basket 28 against the buoyancy of the buoyancy body 17 filled with air, to allow the hydro sound absorber 1 to rise 21 from the basket 28 and to lower 20 it again. The carrier structure 16 of the hydro sound absorber 1 can be movably mounted on the cables 37 between the buoyancy body 17 and the pulling device 32. Apart from the carrier structure 16, the cables 37 can also be used to guide the ballast mechanism 13 or the spacers.

Figure 16:
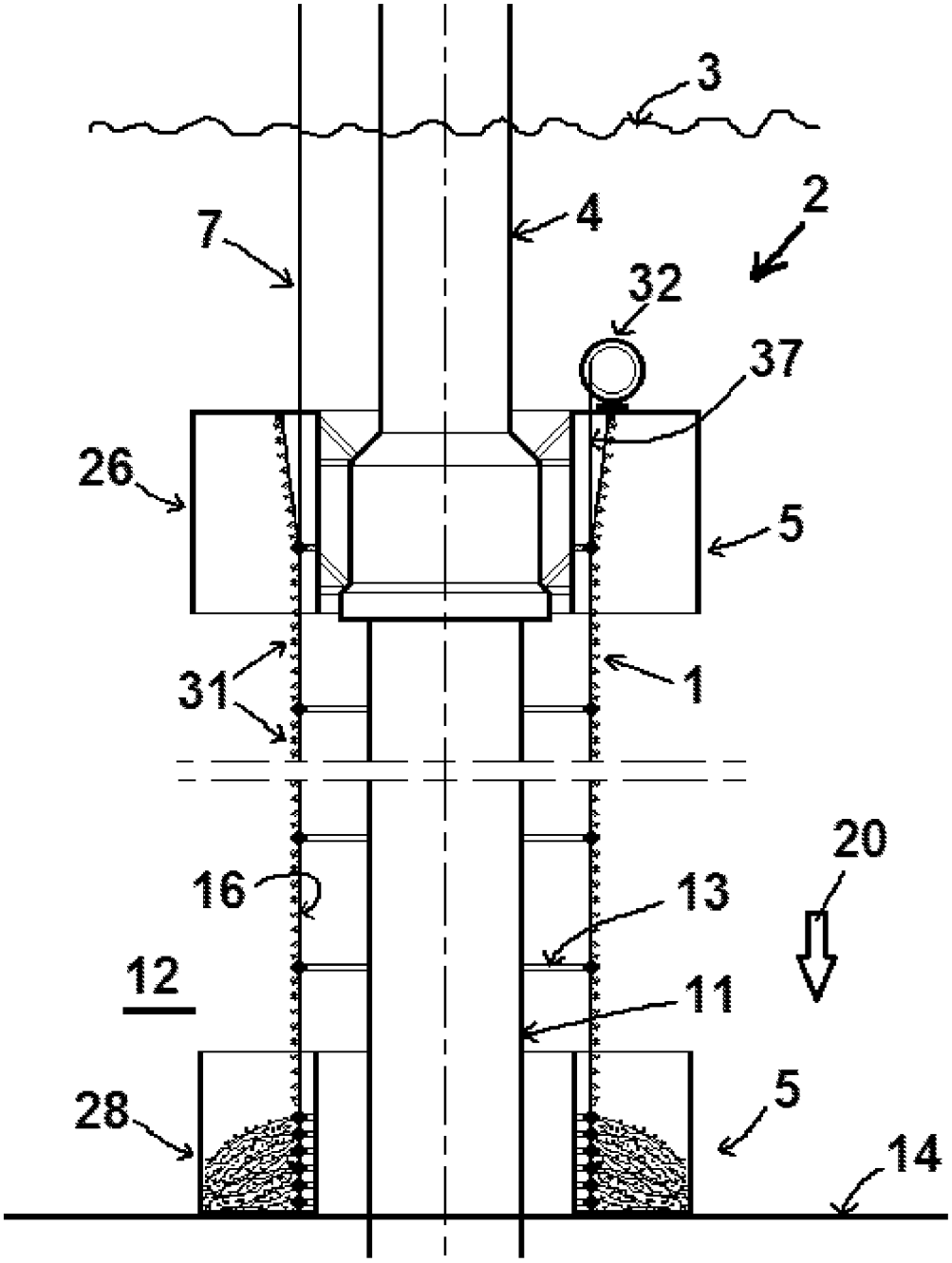
FIG. 16 shows, in a schematic view, various embodiments of the fourth configuration of the invention.
Figure 17:
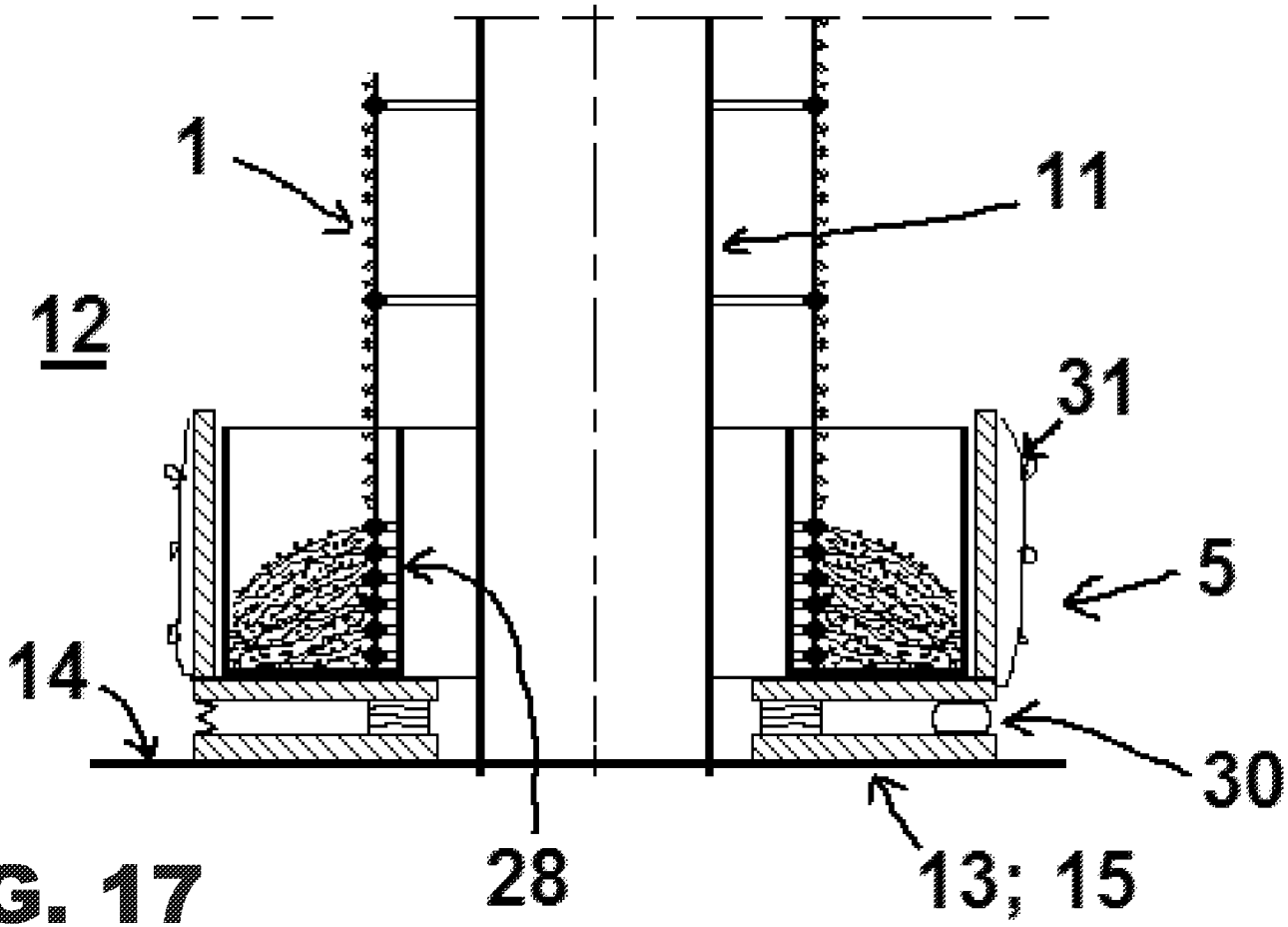
FIG. 17 shows, in a schematic view, embodiments of the fourth and fifth configuration of the invention.
Figure 18:
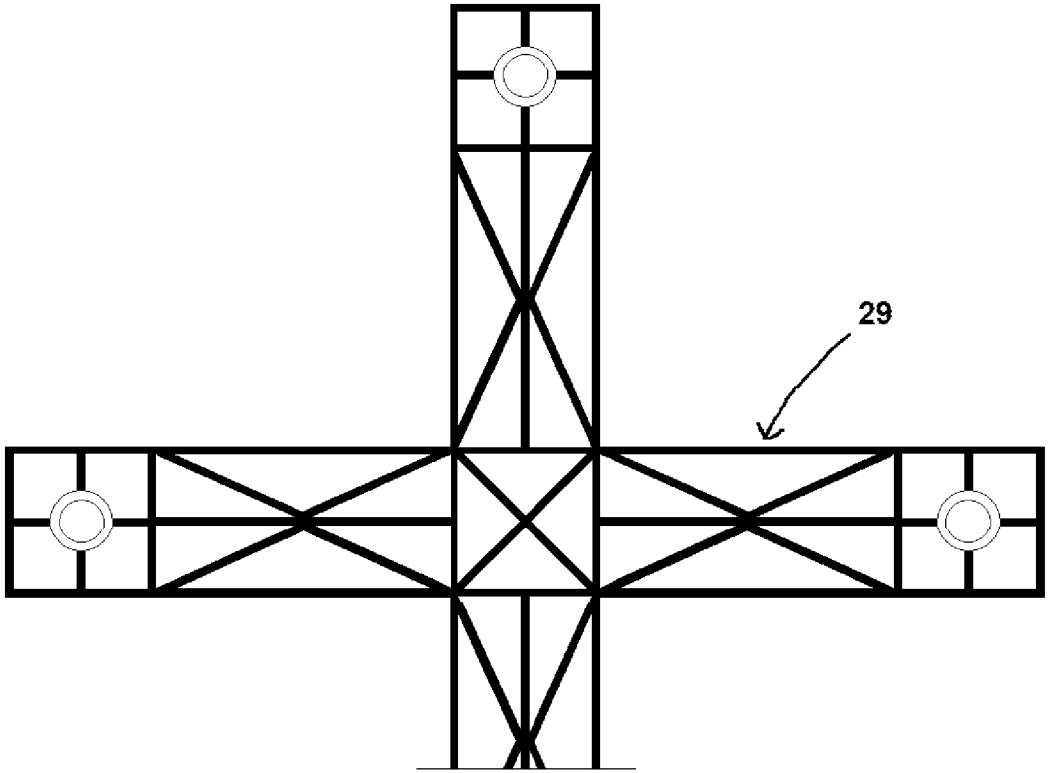
FIG. 18 shows, in a schematic view, a template in a plan view.
Figure 19:
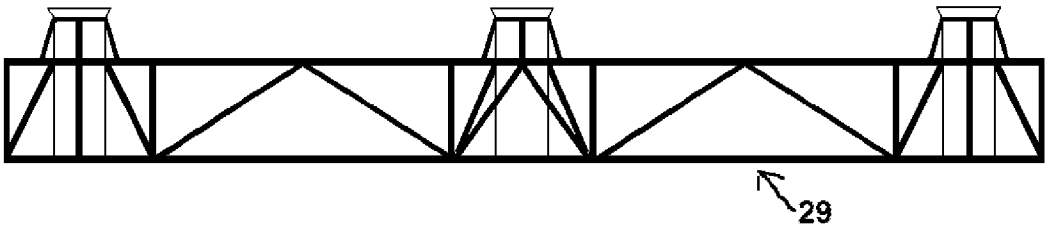
FIG. 19 shows, in a schematic view, a template in a side view.

The embodiments described in FIGS. 11 to 15 are not limited to use with a template 29. FIGS. 16 and 17 show the embodiments in the case of a monopile. FIGS. 18 and 19 show a template 29 without a hydro sound absorber in a detail of a plan view and a side view.

When introducing a pile 11 into the seabed 14, the sound being produced is not only emitted by the pile 11 into the water 12 surrounding it. Sound is also emitted into the water 12 by the vibrations in the seabed 14. To reduce the hydro sound, in other words the sound in the water 12, embodiment variants are shown in FIGS. 20 to 26 according to a further configuration of the invention. These embodiment variants are used to reduce the hydro sound being produced by the interaction of the water 12 and seabed 14.

Figure 20:
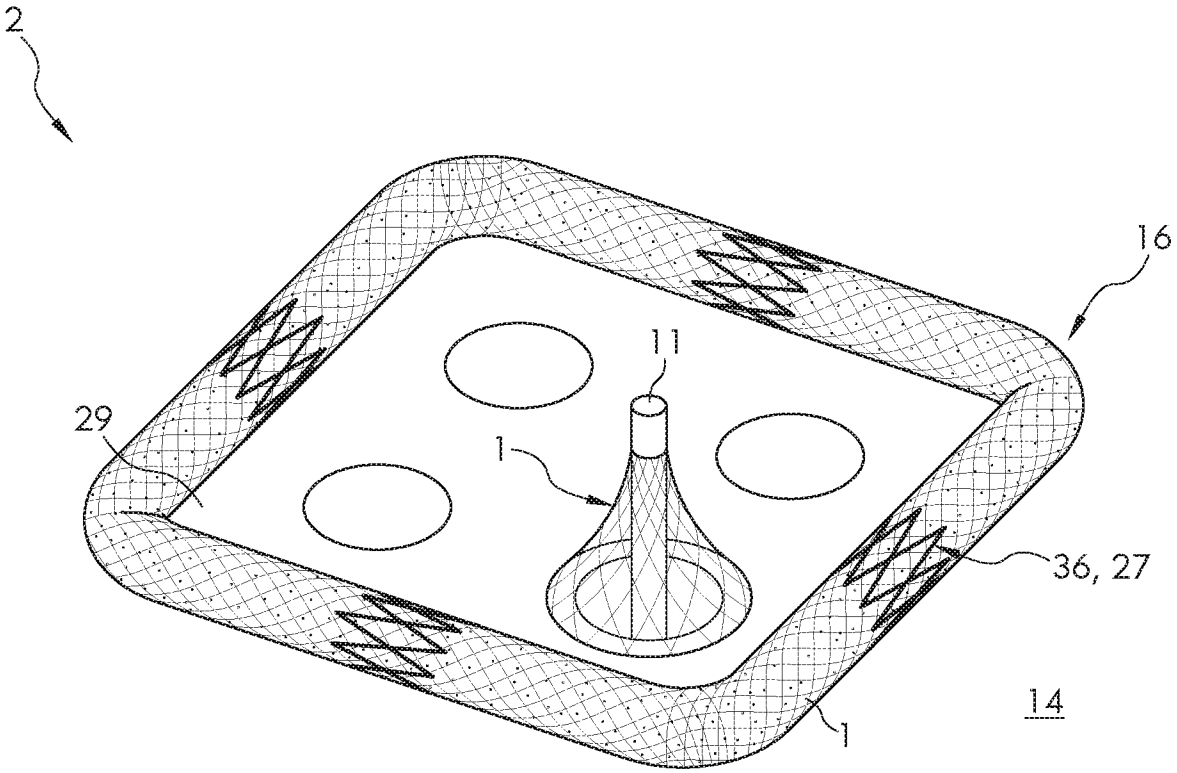
FIG. 20 shows, in a schematic view, a sixth configuration of the invention with a hydro sound absorber spread out parallel to the seabed in a first variant.
Figure 21:
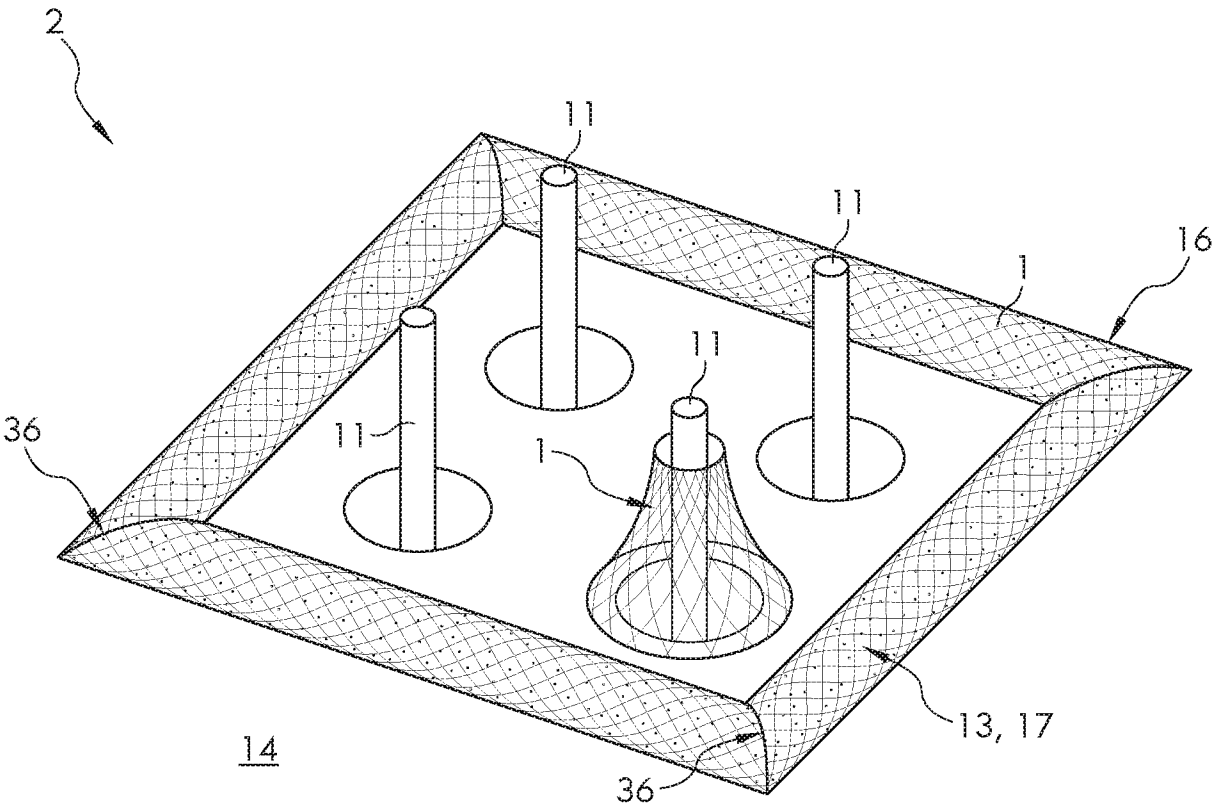
FIG. 21 shows, in a schematic view, a sixth configuration of the invention with a hydro sound absorber spread out parallel to the seabed in a second variant.
Figure 22:
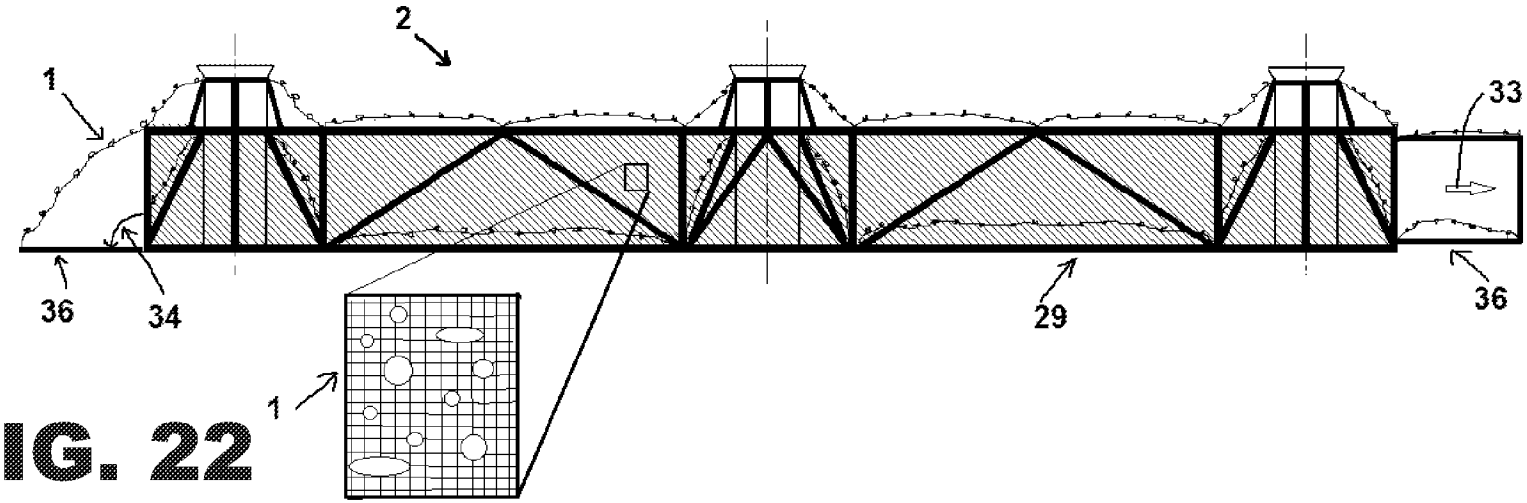
FIG. 22 shows, in a schematic view, a further configuration of the invention with a hydro sound absorber spread out parallel to the seabed.
Figure 23:
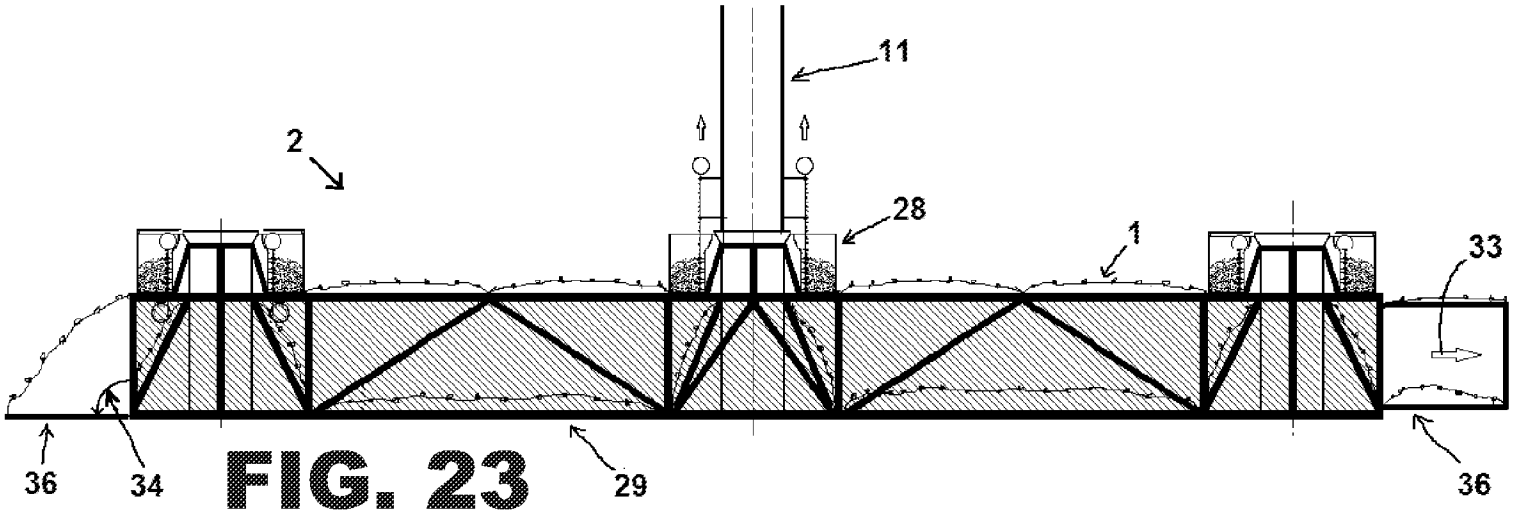
FIG. 23 shows, in a schematic view, a further configuration of the invention with a hydro sound absorber spread out parallel to the seabed.

FIGS. 20 and 21 show a sixth configuration of the invention. The device 2 has a hydro sound absorber 1, which is spread out parallel to the seabed 14. For spreading and hauling in from the seabed 14, the carrier structure 16 is pulled apart by a spreading mechanism 36, for example a shear device 27. The spreading mechanism 26 can be operated pneumatically and/or hydraulically. For buoyancy and lowering, the device 2 has ballast bodies 13 or buoyancy bodies 17 that can be filled with water and/or air. The spreading mechanism 36 is fastened together with the carrier structure 16, as shown, on a template 29. The hydro sound absorber 1 preferably has a round cross section on the seabed 14. In the case of a template 29 for a plurality of piles 11, the cross section may also be angular. The template 29 can moreover also be occupied by a hydro sound absorber 1.

Figure 24:
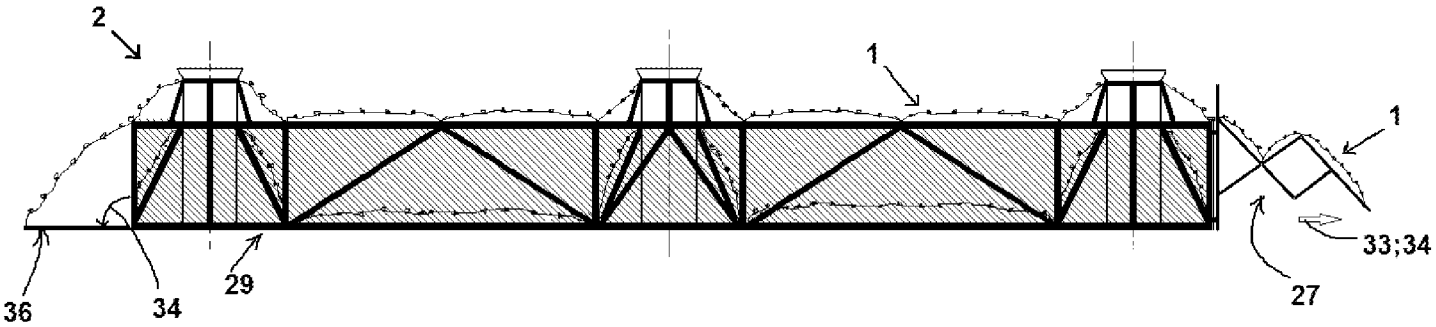
FIG. 24 shows, in a schematic view, a further configuration of the invention with a hydro sound absorber spread out parallel to the seabed.

It is shown in FIGS. 22 to 26 that hydro sound absorbers 1 are arranged in the region of the pile 11 and, in particular, on all the further structures and devices on the seabed 14, such as a template 29 shown in FIGS. 18 and 19. The template 29 is enveloped in a sound-reducing manner on its upper side, on its lower side and in the inner region by the net-like hydro sound absorber 1. The effective covering of the seabed 14 can be achieved by spreading mechanisms 36 that can be folded out 34 or pushed out 33 and are arranged on the sides of the template 29. The spreading mechanisms 36, also called surface elements, are covered with hydro sound absorbers 1. Alternatively, hydro sound absorbers 1, as FIG. 24 shows, can be enlarged by means of horizontal and/or vertical shear devices 27, above all around the piles 11. The shear devices 27 or the spreading mechanisms 36 are preferably arranged on the sides of the template 29.

Figure 25:
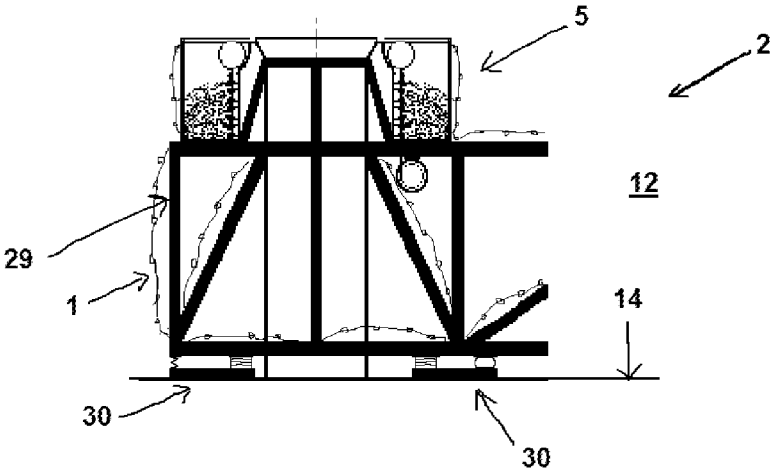
FIG. 25 shows, in a schematic view, a further configuration of the invention with a decoupling mechanism.
Figure 26:
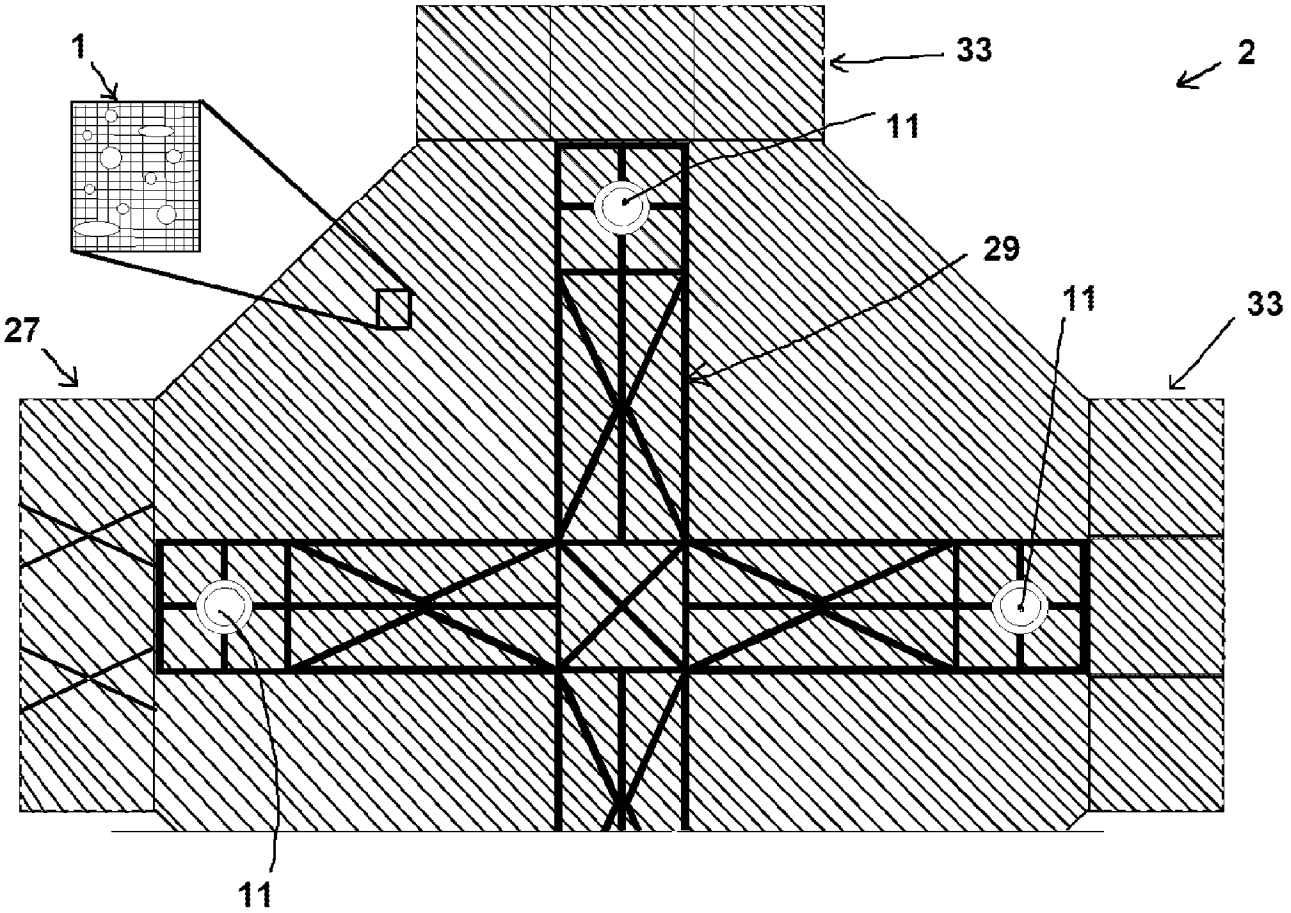
FIG. 26 shows, in a schematic view, a further configuration of the invention with a hydro sound absorber spread out parallel to the seabed.

FIGS. 17 and 25 show a further configuration of the invention. The device 2 in this development of the invention has a plurality of decoupling mechanisms 30 on the basket 28, on the ballast body 13 or on the holding mechanism 15 and/or on the template 29. The decoupling mechanisms 30 are arranged between the lower side of the basket 28 and the seabed 14 or between the lower side of the template 29 and the seabed 14. The decoupling mechanisms 30 shield the basket 28 or the template 29 against bed vibrations. For this purpose, the decoupling mechanisms 30 comprise springs, absorber elements and/or air-filled enveloping bodies. The decoupling mechanisms 30 reduce the transmission of oscillations, vibrations or bed vibrations to the device 2 and/or the template 29 and therefore the forwarding thereof to the water 12 and the production of hydro sound.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A method for handling a hydro sound absorber in the region of an offshore construction site, the method comprising:

prior to beginning noise-emitting work, positioning, close to at least one of a seabed or a surface of the water, a transport housing storing a hydro sound absorber in a contracted first functional position, the transport housing being permeable to water and the hydro sound absorber, which comprises a carrier structure and sound reduction elements fastened to the carrier structure, having a first end and a second end remote from the first end;

spreading, at least one of vertically to the extent of the offshore construction site or horizontally to a geometry of the seabed, the hydro sound absorber out from the contracted first functional position to an at least partially spread-out second functional position; and holding, by a holding mechanism, the first end of the hydro sound absorber while the second end of the hydro sound absorber is movable relative to the holding mechanism, wherein the sound reduction elements fastened to the carrier structure are spaced apart from one another in the at least partially spread-out second functional position, and wherein the transport housing is directly connected to at least one of the first end of the hydro sound absorber or the second end of the hydro sound absorber.

2. The method for handling a hydro sound absorber according to claim 1, wherein after completion of the noise-emitting work, the hydro sound absorber is contracted from a second functional position and is placed in the transport housing in the first functional position, and the transport housing is removed from the offshore construction site.

3. The method according to claim 1, wherein the offshore construction site is a case of a pile to be introduced into the seabed.

4. A device for reducing water sound, the device comprising:

a hydro sound absorber having a first end and a second end remote from the first end, the hydro sound absorber comprising:

a carrier structure, and sound reduction elements fastened to the carrier structure;

a holding mechanism, configured to hold a first end of the hydro sound absorber; and a transport housing that is permeable to water and configured to store and transport the hydro sound absorber in a contracted first functional position, wherein the sound reduction elements fastened to the carrier structure are spaced apart from one another in an at least partially spread-out second functional position, wherein the second end of the hydro sound absorber is movable relative to the holding mechanism, and wherein the transport housing is directly connected to at least one of the first end of the hydro sound absorber or the second end of the hydro sound absorber.

5. The device according to claim 4, wherein the device has at least one of at least one buoyancy body or a ballast body connected at least to the second end of the hydro sound absorber.

6. The device according to claim 5, wherein the device has a buoyancy body connected to the second end of the hydro sound absorber, the device further comprising a collecting device for receiving the buoyancy body of the device.

7. The device according to claim 6, wherein the collecting device is arranged in the region of a surface of the water.

8. The device according to claim 4, further comprising a cable, which connects the first end to the second end of the hydro sound absorber and on which the hydro sound absorber is freely movably arranged.

9. The device according to claim 8, wherein the hydro sound absorber is in an at least partially spread-out second functional position.

10. The device according to claim 4, wherein the transport housing is arranged on at least one of a template or an introduction tool.

11. The device according to claim 10, further comprising a spreading mechanism fastened to at least one of the holding mechanism or the template and via which the hydro sound absorber is spread out horizontally along the seabed.

12. The device according to claim 4, wherein the first end of the hydro sound absorber is associated with a surface of the water, wherein the holding mechanism is at least one of connected to an introduction tool or held by a positioning mechanism of the device independently of a hoist of an introduction tool.

13. The device according to claim 4, wherein the first end of the hydro sound absorber is associated with a seabed, and wherein the holding mechanism is connected to a template.

14. The device according to claim 4, further comprising a pulling device configured to at least one of lower or haul up the second end of the hydro sound absorber, the pulling device including a drive assembly and a pulling means connected to the drive assembly and to the second end of the hydro sound absorber.

15. The device according to claim 14, wherein the drive assembly is disposed on the holding mechanism.

16. The device according to claim 4, further comprising at least one decoupling mechanism disposed on at least one of the holding mechanism or a transport housing or a ballast body or a template.

17. The device according to claim 4, wherein the offshore construction site is a case of a pile to be introduced into the seabed.

18. The device according to claim 4, wherein a template is configured as the transport housing.

19. The device according to claim 4, wherein the second end of the hydro sound absorber is positionable remote from the holding mechanism.

20. The device according to claim 4, wherein the transport housing comprises a first annular basket and a second annular basket, wherein the first annular basket is configured to be pushed into the second annular basket.

* * * * *